US005926202A

United States Patent [19]

Hattori

[11] Patent Number: 5,926,202

[45] **Date of Patent: *Jul. 20, 1999**

[54] OPTICAL SCANNING METHOD AND OPTICAL SCANNING APPARATUS

[75] Inventor: Yutaka Hattori, Kuwana, Japan

[73] Assignee: Brother Kogyo Kabushiki Kaisha, Nagoya, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/723,753

[22] Filed: Sep. 30, 1996

[30] Foreign Application Priority Data

Nov. 20, 1995 [JP] Japan ..... 7-301828

[51] Int. Cl.[6] ..... B41J 2/47; B41J 2/435

[52] U.S. Cl. ..... 347/237; 347/248; 347/250

[58] Field of Search ..... 347/248, 250, 347/255, 232, 247; 356/237, 445, 446; 359/201, 206, 204, 18, 216, 496; 250/578.1

[56] References Cited

U.S. PATENT DOCUMENTS

| | | | |
|---|---|---|---|
| 3,534,166 | 10/1970 | Korpel | 347/241 |
| 4,002,829 | 1/1977 | Hutchison | 347/241 |
| 4,474,422 | 10/1984 | Kitamura | 347/241 |
| 5,157,412 | 10/1992 | Kleinschmidt et al. | 347/232 |
| 5,790,262 | 8/1998 | Kanno | 358/296 |

FOREIGN PATENT DOCUMENTS 7-199097 8/1995 Japan .

*Primary Examiner*—N. Le
*Assistant Examiner*—Thinh NGuyen
*Attorney, Agent, or Firm*—Oliff & Berridge, PLC

[57] ABSTRACT

An optical scanning apparatus includes light beam emitter that emits a plurality of light beams, such as laser beams having different wavelengths, respectively; light beam deflector that deflects the plurality of light beams emitted by the light beam emitter that scans an object; guider that guides the plurality of deflected light beams so that the deflected light beams fall at about the same position on the object; light receiver that receives the reflected light beams reflected from the object of reading; and image information generator that generates image information representing the object based on the reflected light beams. The optical scanning apparatus may further include an image recording system which has recording light beam emitter that emits a recording light beam based on the generated image information; deflector that deflects the recording light beam emitted by the recording light beam emitter to scan a photoconductive body that records an image represented by the image information; and recording light beam director that directs the deflected recording light beam toward the photoconductive body to record an image represented by the image information on the photoconductive body.

20 Claims, 14 Drawing Sheets

OPTICAL SCANNING METHOD AND OPTICAL SCANNING APPARATUS

BACKGROUND OF THE INVENTION

1. Field of the Invention

The present invention relates to an optical scanning apparatus to be employed in an image reading apparatus for reading an image formed on an object of reading by optically scanning the object of reading.

2. Description of Related Art

An image reading apparatus proposed in U.S. Pat. application Ser. No. 08/253,321 filed Jun. 3, 1994 by the applicant of the present patent application, now U.S. Pat. No. 5,610,652, copies an image formed on a document and produces a monochromatic copy of the image. This previously proposed image reading apparatus deflects an image reading light beam emitted by a monochromatic light source by a polygonal rotating mirror to scan an image formed on a document. The light beam is reflected by the image surface of the document and the reflected light beam falls on a light receiving device, such as a photodetector. Image information about the image formed on the document is obtained on the basis of output signals provided by the light receiving device.

Generally, the image information is obtained on the basis of the output signals of the light receiving device by a method that compares the intensity of the light beam emitted by the image reading light source and the intensity of the reflected light beam reflected by the image surface of the document to determine the attenuation of the image reading light beam, and determines the density of the image on the basis of the attenuation.

When producing a copy of an image formed on a document by a copying machine provided with an image reading device of this type, an image on one page of the document is read by the aforesaid method to obtain image information about the image, and the image information is stored in a storage device. Then, a light beam emitted by a recording light source (generally, a semiconductor laser) is modulated according to the image information stored in the storage device, the modulated light beam is deflected by a polygonal rotating mirror onto the surface of a photoconductive body for scanning to form an electrostatic latent image corresponding to the image information on the surface of the photoconductive body. Toner charged in a polarity opposite to that of charges on the photoconductive body sticks to portions of the surface of the photoconductive body forming the electrostatic latent image to form a toner image on the photoconductive body, and then the toner image is transferred to a recording sheet to produce a monochromatic image on the recording sheet.

When the storage device has a large storage capacity, a copying operation may be started after reading all images on the document and storing image information about those images in the storage device.

However, since the prior art copying machine uses the monochromatic light source for reading the images on the document, the copying machine is unable to read portions of multicolor images of some colors with the light beam emitted by the monochromatic light source. Consequently, the thus formed monochromic image is missing portions of the original image of the colors which cannot be read by using the monochromatic light beam and hence the original image cannot be copied with high fidelity.

For instance, when a prevalently used semiconductor laser that emits a red light beam of about 670 nm in wavelength is used for reading a multicolor image, the total reflection of the red light beam occurs in red portions of the multicolor image and, consequently, image information obtained by the foregoing method is missing image information about the red portions.

Although such a problem may be solved by using a white light source, such as a halogen lamp, for reading all portions of colors of an image, a light beam emitted by the white light source, as compared with a laser beam, is unsatisfactory in directivity and focusing capability and hence the resolution of image information obtained by using the light beam emitted by the white light source is low. Since the light beam emitted by the white light source includes radiations of wavelengths outside the visible region, such as infrared radiations, a filter, such as an infrared ray absorbent filter, must be placed on the light receiving surface of a light receiving device to cut the reflected radiations of wavelengths outside the visible region. A copying machine provided with such a filter is complex in structure and expensive.

SUMMARY OF THE INVENTION

The present invention has been made to solve such problems and it is therefore an object of the present invention to make possible reading a multicolor image formed on a document and generating image signals so that the multicolor image formed on the document can be reproduced with high fidelity.

Another object of the present invention is to provide an optical scanning apparatus of a simple structure capable of exactly reading an image formed on a document.

According to a first aspect of the present invention, an optical scanning method comprises steps of emitting a plurality of light beams, such as laser beams, respectively having different wavelengths, deflecting the plurality of light beams for scanning, guiding the plurality of deflected light beams so that the plurality of deflected light beams fall at the same position on an object of reading, such as a document, detecting the plurality of light beams reflected from the object of reading, and generating image information representing the object of reading on the basis of the received reflected light beams.

The optical scanning method according to the first aspect of the present invention emits a plurality of light beams respectively having different wavelengths, deflects the plurality of light beams for scanning, guides the plurality of deflected light beams so that the plurality of deflected light beams fall at the same position on an object of reading, detects the plurality of reflected light beams reflected from the object of reading, and generates image information representing the object of reading on the basis of the received reflected light beams.

Since the image information is generated on the basis of the reflected light beams obtained by projecting the plurality of light beams so that the plurality of light beams fall at the same position on the object of reading and detecting the plurality of reflected light beam from the object of reading, all the portions having different colors of the object of reading can be read even if the object of reading is colored in multiple colors and hence the image information exactly representing a sharp image of the object of reading can be obtained.

According to a second aspect of the present invention, in the optical scanning method according to the first aspect of the present invention, the plurality of light beams are emitted at different moments, respectively.

The optical scanning method according to the second aspect of the present invention has an effect, in addition to those of the first aspect of the present invention, of emitting the plurality of light beams at different moments, respectively.

Since the light beams respectively having different wavelengths are projected at the same position on the object of reading at different moments, respectively, the plurality of light beams are reflected individually, the color separating ability of the image information based on the reflected light beams is improved, and the resolution of the image information is improved.

According to a third aspect of the present invention, in the optical scanning method according to the first or the second aspect, the reflected light beam reflected corresponding to a color of a portion to be read on the object of reading among the plurality of reflected light beams is selected, and the image information is generated on the basis of the selected reflected light beam.

According to the third aspect of the present invention, the reflected light beam reflected from a portion of a color to be read on the object of reading among the plurality of reflected light beams is selected, and the image information is generated on the basis of the selected reflected light beam.

Since the reflected light beam reflected from a portion of a color to be read is selected, and the image information is generated on the basis of the selected reflected light beam, an image of an improved sharpness can be reproduced by using the image information.

According to a fourth aspect of the present invention, an optical scanning apparatus comprises light beam emitting means for emitting a plurality of light beams, such as laser beams, respectively having different wavelengths, light beam deflecting means, such as a polygonal rotating mirror, for deflecting the plurality of light beams emitted by the light beam emitting means for scanning, guiding means, such as a dichroic mirror and a focusing lens, for guiding the plurality of deflected light beams so that the plurality of deflected light beams fall at the same position on an object of reading, light receiving means, such as a photodetector, for receiving the reflected light beam reflected from the object of reading, and image information generating means, such as a CPU, for generating image information representing the object of reading on the basis of the reflected light beams.

The light beam emitting means of the optical scanning apparatus according to the fourth aspect of the present invention emits light beams respectively having different wavelengths, the deflecting means deflects the plurality of light beams emitted by the light beam emitting means for scanning, the guiding means guides the plurality of deflected light beams so that the deflected light beams fall at the same position on an object of reading, the light receiving means receives the reflected light beam reflected from the object of reading, and the image information generating means generates image information representing the object of reading on the basis of the reflected light beams.

Therefore, the image information is generated on the basis of the reflected light beams, i.e., the plurality of light beams respectively having different wavelengths, projected at the same position on the object of reading and reflected from the object of reading. Consequently, all the portions of the object of reading in different colors can be read even if the object of reading is colored in multiple colors and hence image information representing a sharp image of high fidelity of the object of reading can be obtained.

According to a fifth aspect of the present invention, in the optical scanning apparatus in the fourth aspect of the present invention, the light beam emitting means is provided with light emission timing control means, such as a CPU, for timing the emission of the plurality of light beams so that the plurality of light beams are emitted at different moments, respectively.

The optical scanning apparatus according to the fifth aspect of the present invention has an effect, in addition to those of the optical scanning apparatus according to the fourth aspect of the present invention, of controlling the timing of emission of the plurality of light beams so that the plurality of light beams are emitted at different moments, respectively, by the control means.

Since the plurality of light beams respectively having different wavelengths are emitted at different moments toward the same position on the object of reading, the plurality of light beams are reflected individually, the color separating ability of the image information generated on the basis of the reflected light beam is improved, and the image information represents an image in an improved resolution.

Since the plurality of light beams fall substantially at the same position on the object of reading at different moments, the optical scanning apparatus is able to read the object of reading more rapidly than an optical scanning apparatus that repeats a scanning cycle for a plurality of light beams.

According to a sixth aspect of the present invention, in the optical scanning apparatus in the fourth or the fifth aspect of the present invention, the image information generating means is provided with selecting means, such as a CPU, for selecting the reflected light beam corresponding to a color of a portion of the object of reading among the plurality of reflected light beams, and generates the image information on the basis of the selected reflected light beam.

The optical scanning apparatus according to the sixth aspect of the present invention has an effect, in addition to those of the optical scanning apparatus according to the fourth or the fifth aspect of the present invention, of selecting the reflected light beam reflected from portions of colors to be read of the object of reading among the plurality of light beams by the selecting means, and generating the image information on the basis of the selected reflected light beam by the image information generating means.

Since the image information is generated on the basis of the selected reflected light beams reflected from the portions of colors to be read of the object of reading, the image information represents an image of an improved sharpness.

According to a seventh aspect of the present invention, in the optical scanning apparatus according to any one of the fourth to the sixth aspects of the present invention, the light emitting means comprises a plurality of light emitting elements, a first light emitting element among the plurality of light emitting elements being a red light emitting element that emits a red light beam having the wavelength of red light, and a second light emitting element among the plurality of light emitting elements being a green light emitting element that emits a green light beam having the wavelength of green light.

In the optical scanning apparatus according to the seventh aspect of the present invention, the light emitting means includes the plurality of light emitting elements, the first light emitting element among the plurality of light emitting elements being a red light emitting element that emits a red light beam having the wavelength of red light, and the second light emitting element among the plurality of light emitting elements being a green light emitting element that emits a green light beam having the wavelength of green light.

Accordingly, all the portions having different colors of the object of reading excluding yellow portions can be read even if the object of reading is colored in multiple colors and hence image information substantially exactly representing a sharp image of the object of reading can be obtained.

According to an eighth aspect of the present invention, in the optical scanning apparatus according to any one of the fourth to the sixth aspects of the present invention, the light emitting means comprises a plurality of light emitting elements, a first light emitting element among the plurality of light emitting elements being a red light emitting element that emits a red light beam having the wavelength of red light, a second light emitting element among the plurality of light emitting elements being a green light emitting element that emits a green light beam having the wavelength of green light, and a third light emitting element among the plurality of light emitting elements being a blue light emitting element that emits a blue light beam having the wavelength of blue light.

In the optical scanning apparatus according to the eighth aspect of the present invention, the light emitting means includes the plurality of light emitting elements, the first light emitting element among the plurality of light emitting elements being a red light emitting element that emits a red light beam having the wavelength of red light, the second light emitting element among the plurality of light emitting elements being a green light emitting element that emits a green light beam having the wavelength of green light, and the third light emitting element among the plurality of light emitting elements being a blue light emitting element that emits a blue light beam having the wavelength of blue light.

Accordingly, all the portions having different colors of the object of reading can be read even if the object of reading is colored in multiple colors and hence image information exactly representing a sharp image of the object of reading can be obtained.

Since the red light beam having the wavelength of red light, the green light beam having the wavelength of green light and the blue light beam having the wavelength of blue light are projected at different moments, respectively, onto the same portion on the object of reading, the plurality of light beams are reflected individually and hence the light receiving means that receives the reflected light beams need not be provided with any separating means for separating the reflected light beam having the wavelength of red light, the reflected light beam having the wavelength of green light and the reflected light beam having the wavelength of blue light, so that the structure of the optical scanning apparatus can be simplified.

According to a ninth aspect of the present invention, in the optical scanning apparatus in the seventh or the eighth aspect of the present invention, the light emitting elements are semiconductor lasers.

Semiconductor lasers are capable of emitting highly directional light beams having short wavelengths, using low power.

According to a tenth aspect of the present invention, in the optical scanning apparatus according to the seventh or the eighth aspect of the present invention, each of the light emitting elements has a solid state laser, such as a YAG laser (yttrium-aluminum-garnet laser), that emits a light beam of a predetermined wavelength, and a wavelength changing element that generates a light beam having a frequency which is an integral multiple of an incident laser light, such as an SHG element (second harmonic generating element).

The optical scanning apparatus according to the tenth aspect of the present invention has a function, in addition to those of the optical scanning apparatus according to the seventh or the eighth aspect of the present invention, to emit a light beam of a predetermined wavelength by the solid state laser. The wavelength changing element changes the predetermine wavelength of the light beam. Since a plurality of light beams respectively having different wavelengths can be emitted by a single solid state laser, a light source can be simplified.

According to an eleventh aspect of the present invention, the optical scanning apparatus according to any one of the seventh to the tenth aspects of the present invention further comprises recording light beam emitting means, such as a semiconductor laser, for emitting a recording light beam on the basis of the generated image information, deflecting means, such as a polygonal rotating mirror, for deflecting the recording light beam for scanning, a photoconductive body for recording thereon an image corresponding to the image information, and light beam directing means, such as a reflecting mirror, for directing the deflected recording light beam toward the photoconductive body to record the image corresponding to the image information.

The optical scanning apparatus according to the eleventh aspect of the present invention has an effect, in addition to those of the optical scanning apparatus according to any one of the seventh to the tenth aspects of the present invention, of emitting the recording light beam on the basis of the generated image information by the recording light beam emitting means. The deflecting means deflects the recording light beam for scanning, and then the recording light beam directing means directs the deflected recording light beam toward the photoconductive body. The photoconductive body irradiated with the directed recording light beam forms an image corresponding to the image information.

Since an image is recorded on the basis of the image information obtained by using the plurality of light beams having different wavelengths, all the portions having different colors of the object of reading can be read even if the object of reading is colored in multiple colors and hence a sharp image exactly reproducing the object of reading can be recorded with high fidelity.

According to a twelfth aspect of the present invention, in the optical scanning apparatus according to the eleventh aspect of the present invention, the recording light beam emitting means is one of the plurality of light emitting elements, and the photoconductive body has a photoconductive surface sensitive to the recording light beam emitted by the light emitting element.

The optical scanning apparatus according to the twelfth aspect of the present invention has an effect, in addition to those of the optical scanning apparatus in the eleventh aspect of the present invention, of using one of the plurality of light emitting elements as the recording light beam emitting means, and the photoconductive body has the photoconductive surface sensitive to the recording light beam emitted by the light emitting element.

Since one of the image reading light beam emitting elements is used as the recording light beam emitting element, the structure of the optical scanning apparatus can be simplified.

BRIEF DESCRIPTION OF THE DRAWINGS

Preferred embodiments of the present invention will be described in detail with reference to the following drawings, wherein.

DETAILED DESCRIPTION OF THE PREFERRED EMBODIMENTS

(I) First Embodiment

An optical apparatus in a first embodiment according to the present invention will be described with reference to FIGS. 1 to 7.

(A) Structure of Optical Scanning Apparatus

The structure of the optical scanning apparatus S in the first embodiment as applied to a copying machine having an optical system serving as both an image reading system and an image recording system will be described with reference to FIGS. 1 and 2.

Figure 1:
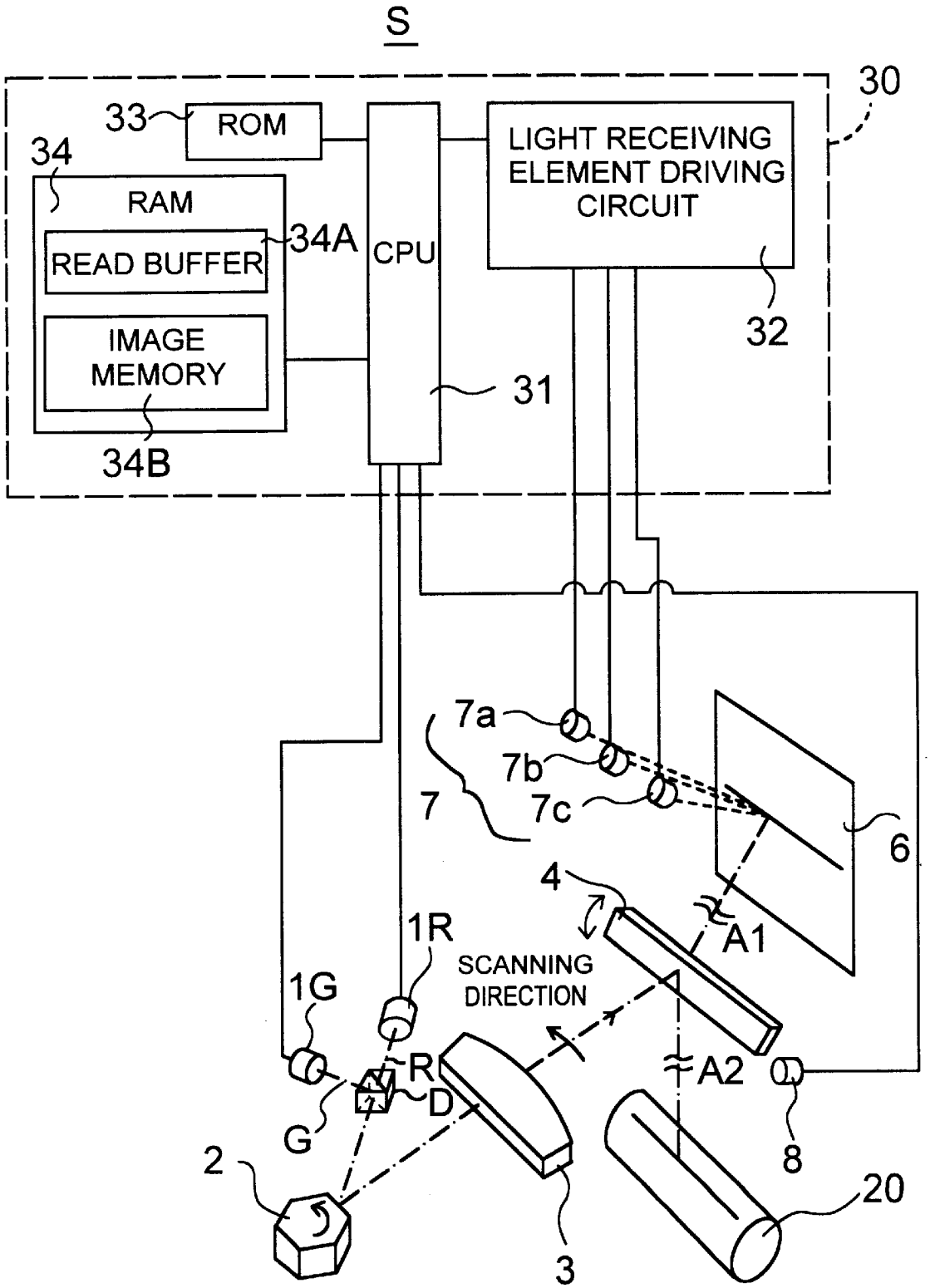
FIG. 1 is a view showing a configuration of an optical scanning apparatus in a first embodiment according to the present invention.
Figure 2:
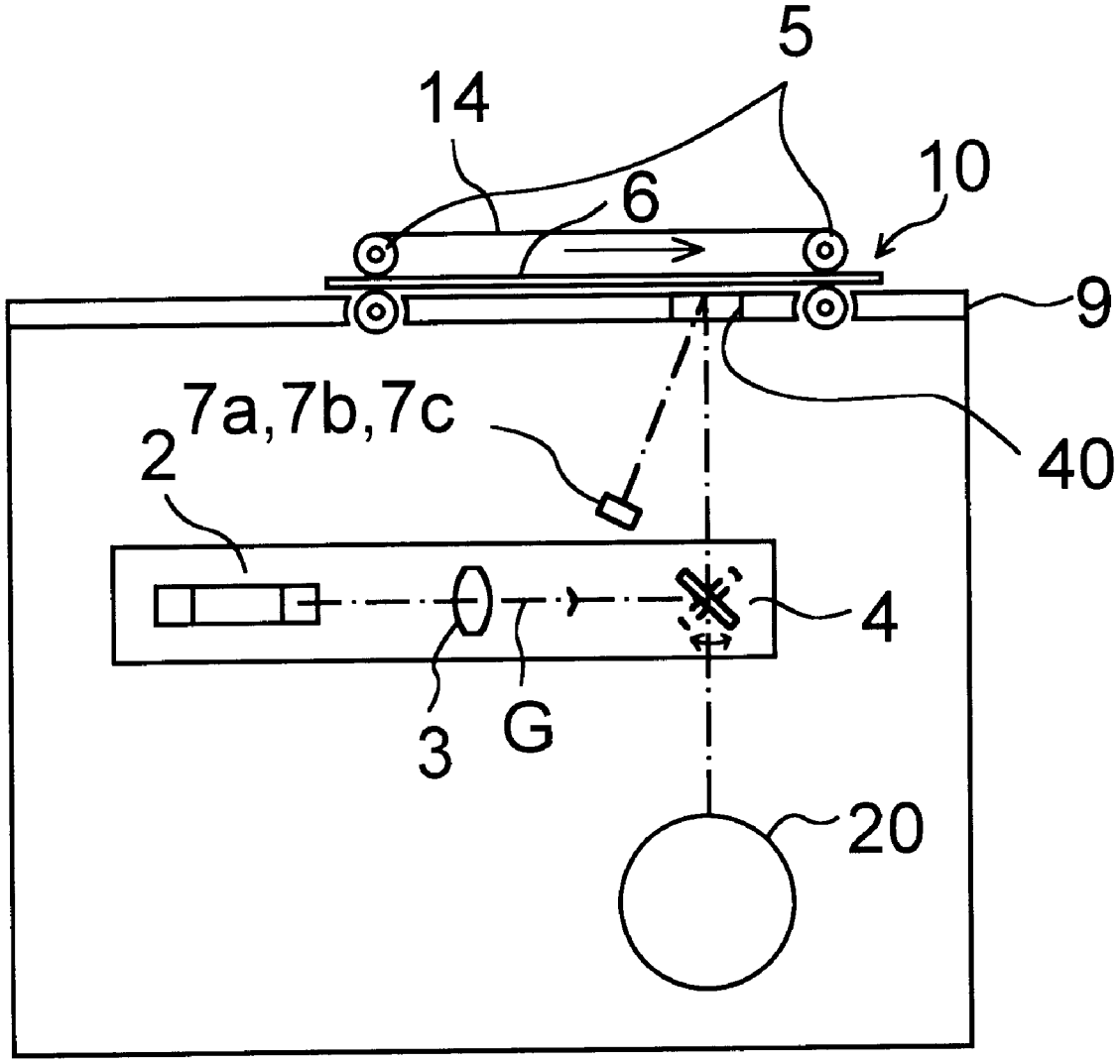
FIG. 2 is schematic side view of a copying machine incorporating the optical scanning apparatus in the first embodiment.

Referring to FIGS. 1 and 2, the optical scanning apparatus S has an image reading system. The image reading system comprises a red semiconductor laser 1R and a green semiconductor laser 1G, which serve as light sources and recording light beam emitting means, a dichroic mirror D which transmits a red light beam R emitted by the red semiconductor laser 1R and reflects a green light beam G emitted by the green semiconductor laser 1G so that the red light beam R and the green light beam G travel the same optical path, a polygonal rotating mirror 2 which deflects the red light beam R or the green light beam G in the direction of the arrow shown in FIG. 1 for scanning, a focusing lens 3 for focusing the red light beam R or the green light beam G deflected by the polygonal rotating mirror 2, a reflecting mirror 4 which reflects the red light beam R or the green light beam G focused by the focusing lens 3 selectively toward a document 6 (object of reading) or a photoconductive body 20, which will be described later, a document conveying unit 10 which supports and conveys the document 6, a light receiving unit 7 which receives a reflected light beam, i.e., the red light beam R or the green light beam G reflected onto the document 6 by the reflecting mirror 4 and reflected from the document 6, and generates an image signal representing an image of the document 6, a BD sensor 8 disposed outside a scanning range, in which the light beams are moved to scan the document 6, so as to receive the red light beam R or the green light beam G every one scanning cycle, and a control unit 30 for controlling the operations of the optical scanning apparatus S.

The timing of the light emitting operations of the red semiconductor laser 1R and the green semiconductor laser 1G is controlled by a CPU 31, which serves as image information generating means, light beam emission timing means and selecting means, so that the red semiconductor laser 1R and the green semiconductor laser 1G are actuated for light emission at different moments, respectively. The CPU 31 is disposed behind the polygonal rotating mirror 2 as viewed in FIG. 2. The reflecting mirror 4 is disposed on an optical path extending through the polygonal rotating mirror 2 and the focusing lens 3. The reflecting mirror 4 can be turned in the directions of the arrows shown in FIG. 1 by a motor, not shown.

The document conveying unit 10 comprises a document table 9, and two pairs of rollers 5 which hold the document 6 between the corresponding rollers 5 to move the document 6. The document table 9 is provided with an opening 40 through which the light beam reflected by the reflecting mirror 4 travels and falls directly on the document 6.

The light receiving unit 7 comprises three photodiodes 7*a*, 7*b* and 7*c*, i.e., photoelectric elements, arranged at equal intervals in a direction perpendicular to a document conveying direction and parallel to a scanning direction in which the document 6 is scanned on the side of the document conveying unit 10 with respect to the reflecting mirror 4. The photodiodes 7*a*, 7*b* and 7*c* are connected to a light receiving element driving circuit 32, which will be described later.

The control unit 30 comprises the light receiving element driving circuit 32 for synthesizing image signals provided by the photodiodes 7*a*, 7*b* and 7*c*, a RAM (random-access memory) 34 for temporarily storing a composite signal produced by synthesizing the image signals provided by the photodiodes 7*a*, 7*b* and 7*c*, a ROM (read-only memory) 33 storing control programs including a program expressed by a flow chart shown in FIG. 4, and the CPU 31 which controls those components. The RAM 34 comprises a read buffer 34A for temporarily storing image signals representing an image formed on the document 6, and an image memory 34B for storing image information about at least one page of the document 6 transferred thereto from the read buffer 34A.

The image recording system comprises the red semiconductor laser 1R (or the green semiconductor laser 1G) which emits a recording light beam, the polygonal rotating mirror 2, the focusing lens 3, the reflecting mirror 4, and the photoconductive body 20 having a surface to be irradiated with a light beam to form an electrostatic latent image thereon. The CPU 31 controls the rotation of the photoconductive body 20 so that the photoconductive body 20 turns through a predetermined angle every time the red light beam R or the green light beam G scans one scanning line.

An arrangement of the red semiconductor laser 1R, the green semiconductor laser 1G, the dichroic mirror D, the polygonal rotating mirror 2, the focusing lens 3 and the reflecting mirror 4 on a copying machine will be described with reference to FIG. 3.

Figure 3:
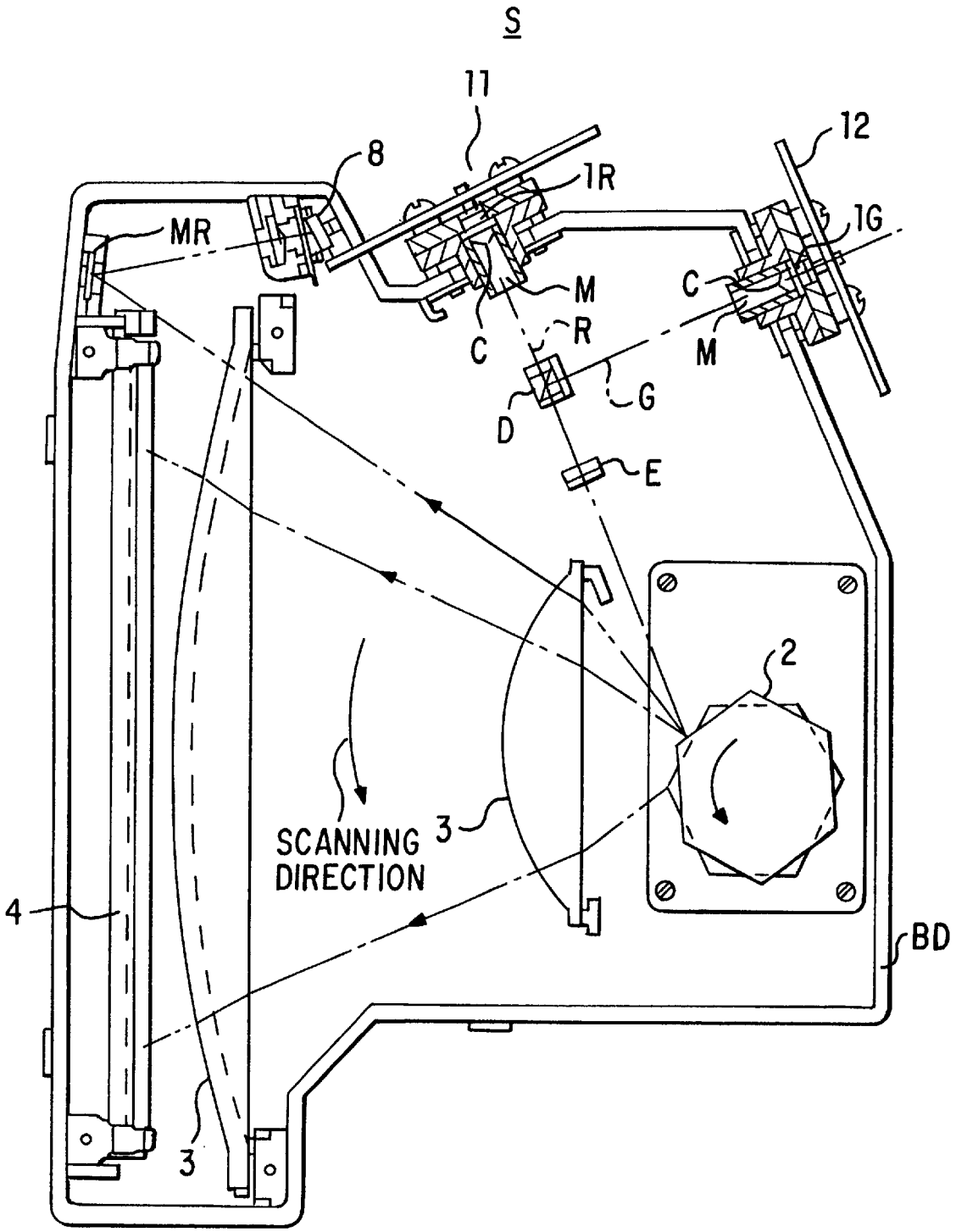
FIG. 3 is a schematic sectional view of the optical scanning apparatus in the first embodiment.

Referring to FIG. 3, a red semiconductor laser unit 11 including the red semiconductor laser 1R and a green semiconductor laser unit 12 including the green semiconductor laser 1G are disposed within a case BD with the optical axes of the red semiconductor laser 1R and the green semiconductor laser 1G substantially perpendicularly intersecting each other. The red light beam R or the green light beam G travels through a collimating lens C for focusing the light beam in a parallel beam and a diaphragm M for controlling the cross section of the light beam passing through it to form a spot of a predetermined diameter on the document 6, and falls on the dichroic mirror D.

The dichroic mirror D transmits the red light beam R and reflects the green light beam R so that the red light beam R and the green light beam G travel the same optical path. Then the red light beam R or the green light beam G travels through a cylindrical lens E that converges a light beam only in a single direction, and falls on one of the facets of the polygonal rotating mirror 2, i.e., a hexahedral rotating mirror, disposed at a focal point of the cylindrical lens E.

The polygonal rotating mirror 2 is rotated at a fixed rotating speed to move the red light beam R or the green light beam G at a fixed speed within the sheet as viewed in FIG. 3 so as to fall on the reflecting mirror 4. The red light beam R or the green light beam G is reflected by a reflecting mirror MR disposed outside the light receiving surface of the reflecting mirror 4 onto a BD sensor 8 every one scanning cycle.

The BD sensor 8 is a photodiode. A position of the light beam on a scanning line on the document 6 is calculated on the basis of a signal provided by the BD sensor 8 as a function of time elapsed from a moment when the red light beam R or the green light beam G falls on the BD sensor 8, i.e., scanning start time.

(B) Operation of Image Reading System

The operation of the image reading system of the optical scanning apparatus S will be described with reference to FIGS. 2 and 4 to 7.

A document is placed at a document feed position and a copy switch is turned on. Upon the detection of the document by a document sensor, the reflecting mirror 4 is turned to a first position indicated by broken lines in FIG. 2 by the motor, not shown.

Figure 4A:
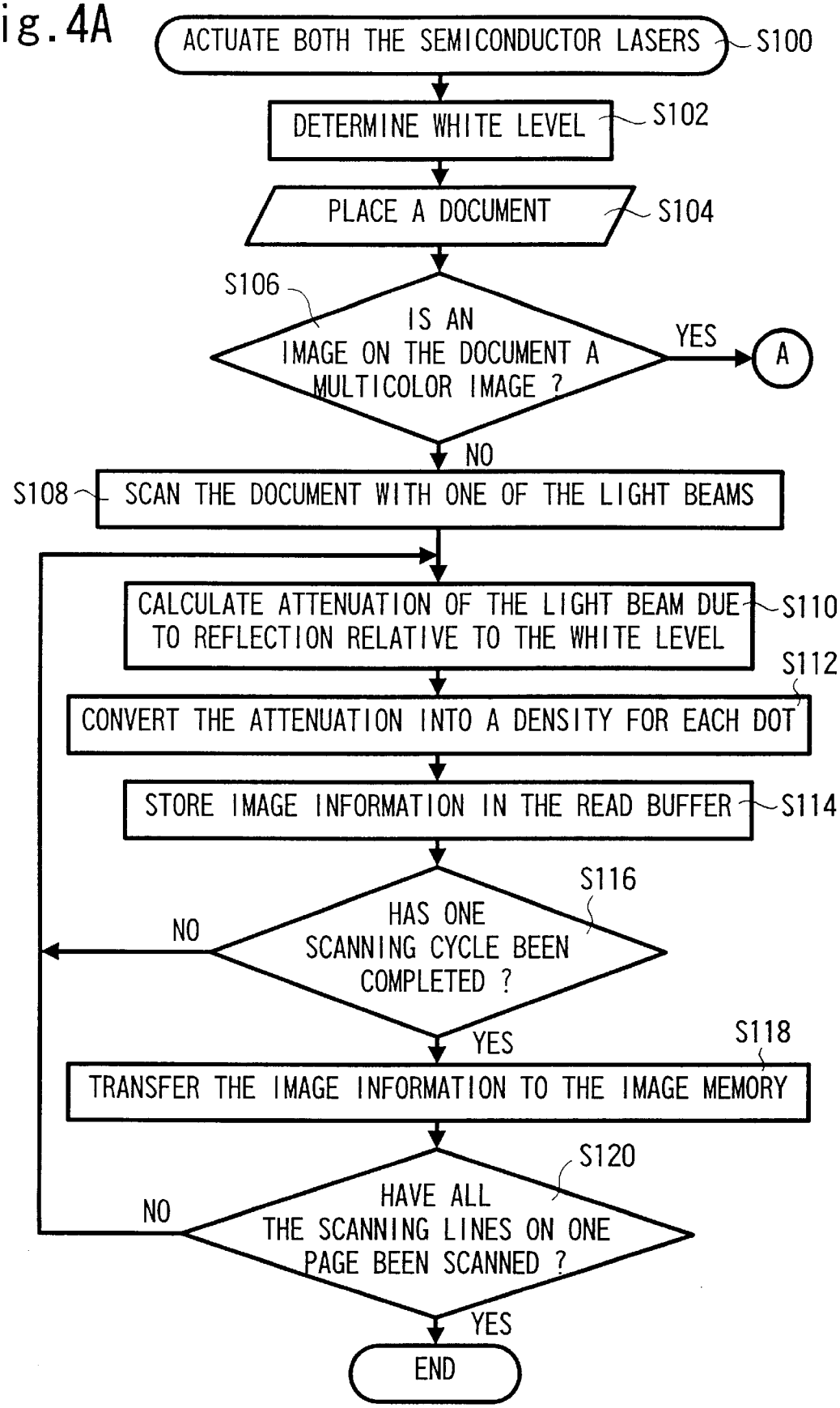
FIGS. 4A and 4B show a flow chart of an image reading procedure to be carried out by the optical scanning apparatus in the first embodiment.

Subsequently, the red semiconductor laser 1R and the green semiconductor laser 1G are actuated sequentially in step S100, as shown in FIG. 4A, to be projected on a white plate, not shown, which is uniformly white in color. The light beams emitted by the semiconductor lasers and reflected from the white plate 14 are detected by the photodiodes 7*a,* 7*b* and 7*c,* and the respective intensities of the reflected light beams are calculated. Then, in step S102, the luminous intensities of the semiconductor lasers are adjusted for so-called white level setting so that the respective intensities of the reflected light beams are equal to each other. The intensity of each reflected laser beam may be used instead of the white level set in step S102 as the white level of the corresponding semiconductor laser.

After the completion of white level setting, the rollers 5 are driven to convey the document 6 onto the document table 9 in step S104. A color type signal indicating the color type of an image on the document 6, i.e., a multicolor type or a non-multicolor type, is given by operating an input device, not shown, such as a keyboard, in step S106. When the color type signal does not indicate a multicolor document, i.e., when the response in step S106 is negative, the red semiconductor laser 1R or the green semiconductor laser 1G is actuated in step S108 to emit either the red light beam R or the green light beam G. The red light beam R or the green light beam G is selected by the operator with reference to colors of an image on the document 6 placed on the document table 9, and the light beam that is attenuated more greatly when reflected from the image than the other is selected. In most cases, the green light beam is used for reading the document. Therefore, when no light beam is specified by the operator, the green semiconductor laser 1G may automatically be selected.

The following description will be made on an assumption that the green semiconductor laser 1G is actuated when a document other than multicolor documents is placed on the document table 9.

In step 108, the CPU 31 keeps the green light beam G being emitted until the trailing end of the document 6 passes through the opening 40. The green light beam G thus emitted falls on and deflected by the polygonal rotating mirror 2 rotating at a fixed rotating speed and is focused by the focusing lens 3, and the focused green light beam G falls on the reflecting mirror 4. Then, the green light beam G is reflected by the reflecting mirror 4 toward the opening 40 of the document table 9 and falls on the document 6 covering the opening 40.

Then, the image surface of the document 6 reflects the green light beam G through the opening 40 into the copying machine. Generally, an image, such as character or the like, is formed in a predetermined color on the document 6. Therefore, the green light beam G is absorbed partially by the image according to the color of the image and, consequently, the intensity of the green light beam G decreases. On the other hand, generally, portions of the document 6 in which no image is formed is white and hence the green light beam G is scarcely absorbed by those portions. Therefore, the intensity of the green light beam G reflected from the portions of the document 6 in which no image is formed is higher than that of the green light beam G reflected from an image on the document 6. The reflected green light beam G falls on the photodiodes 7*a,* 7*b* and 7*c,* and the photodiodes 7*a,* 7*b* and 7*c* generate image signals. An attenuation of the green light beam G due to reflection by the image surface of the document 6 is calculated in step S110 by comparing a synthesized signal obtained by synthesizing the image signals corresponding to scanning positions on the document 6 with the white level determined in step S102.

An operation for synthesizing the image signals provided by the photodiodes 7*a,* 7*b* and 7*c* for each scanning position is performed on the basis of an elapsed time elapsed from the moment the green light beam G falls on the BD sensor 8, which represents a scanning position on the document 6.

After the determination of the attenuation of the green light beam G by comparing the reflected green light beam with the white level in step S110, the attenuation is converted into a density for each dot corresponding to one dot in the image in step S112. Image information, i.e., the densities of dots on each scanning line, is stored in the read buffer 34A of the RAM 34 in step S114. The output of the BD sensor 8 is examined in step S116 to see whether or not one scanning cycle for scanning one scanning line has been completed. When the scanning cycle has not been completed, i.e., when the response in step S116 is negative, the program returns to step S110 to obtain image information about the next dot.

After the scanning line has entirely been scanned, i.e., when the response in step S116 is affirmative, the image information for one scanning line stored in the read buffer 34A is transferred to the image memory 34B of the RAM 34 in step S118. Subsequently, a query is made in step S120 to see whether or not all the scanning lines on one page have been scanned. When the response in step S120 is negative, the program returns to step S110 to continue the scanning operation. When the response in step S120 is affirmative, the image reading program is ended.

Figure 4B:
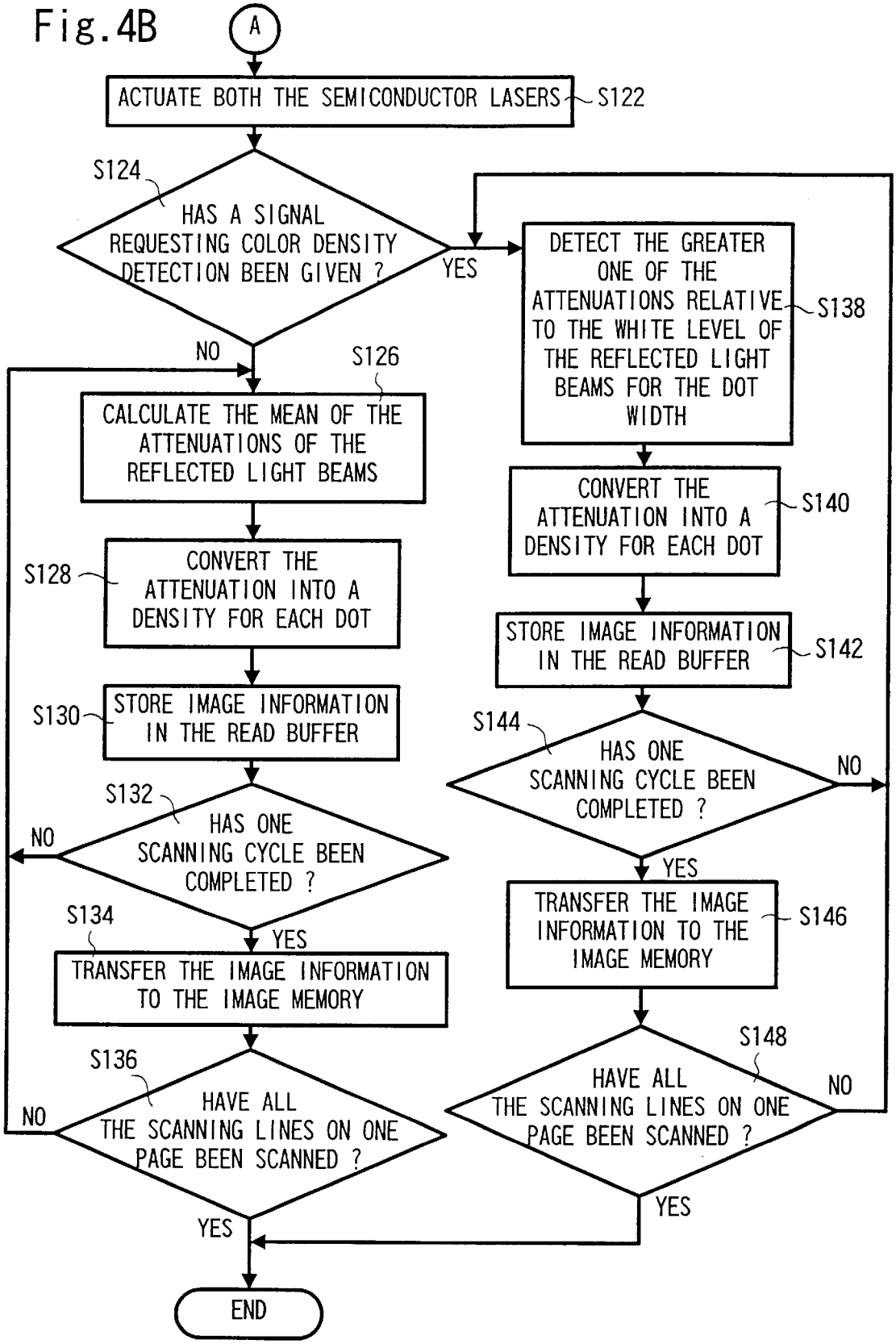

When a color type signal indicating a multicolor image is given, i.e., the response to a query in step S106 is affirmative, both the red semiconductor laser 1R and the green semiconductor laser 1G are actuated in step S122, as shown in FIG. 4B, so that the red light beam R and the green light beam G are emitted at different moments, respectively. The red light beam R and the green light beam G travel through the dichroic mirror D, the polygonal rotating mirror 2, the focusing lens 3 and the reflecting mirror 4 and fall on the surface of the document 6. The timing of the light emitting operations of the red semiconductor laser 1R and the green semiconductor laser 1G is controlled by the CPU 31. A mode of light emission timing operation will be described with reference to FIG. 5.

Figure 5:
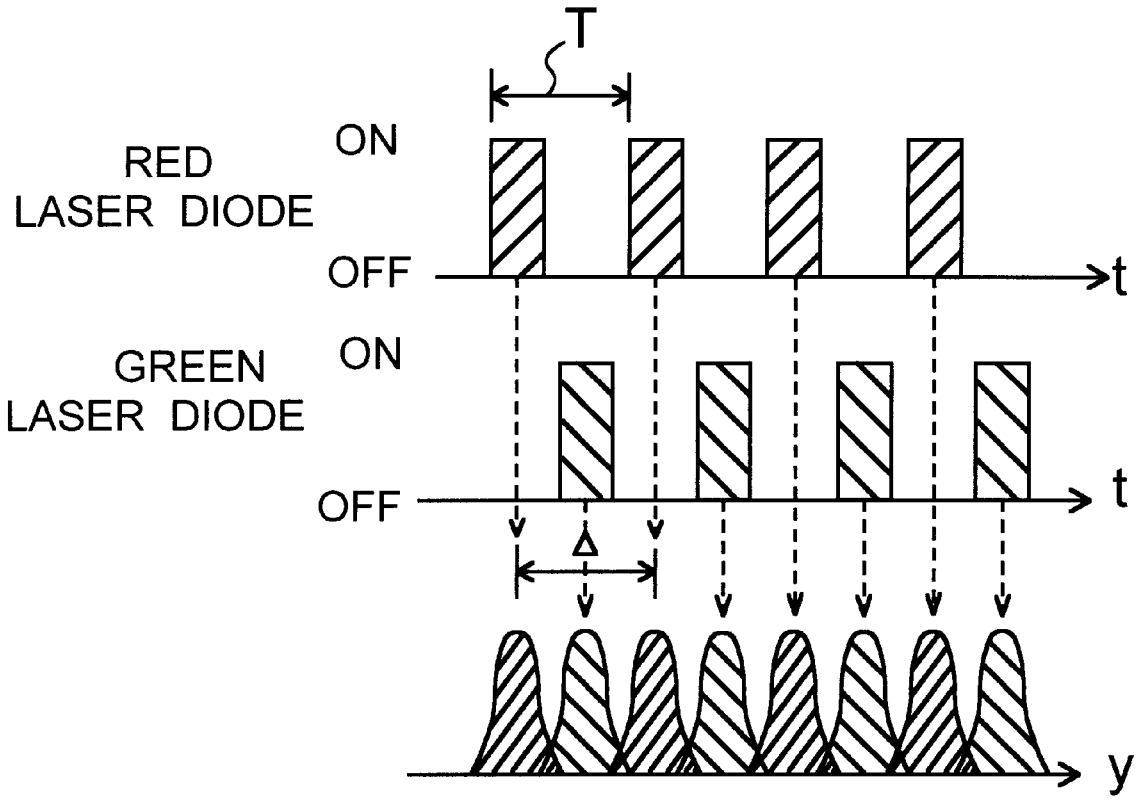
FIG. 5 is a timing chart showing the timing of light emitting operations of semiconductor lasers included in the optical scanning apparatus in the first embodiment.

In FIG. 5, the top diagram shows the light emitting operation of the red semiconductor laser 1R, the middle diagram shows the light emitting operation of the green semiconductor laser 1G, and the bottom diagram shows the intensity distribution of spots of the red light beam R and the green light beam G on the document 6.

As shown in FIG. 5, the red semiconductor laser 1R and the green semiconductor laser 1G emit the red light beam R and the green light beam G once in each dot clock T corresponding to one dot on the image, and the duration of each of the red light beam R and the green light beam G is shorter than T/2. More concretely, the clock dot cycle T is about 80 nsec when image recording condition requires a resolution of 600 dpi (dot per inch), a sheet size of A4, and printing speed of 12 PPM (pages per minute).

In the bottom diagram in FIG. 5, one dot width is indicated by a mark Δ. The red light beam R or the green light beam G is projected at a position in one dot width on the document 6. The position of incidence is determined by controlling the rotating speed of the polygonal rotating mirror 2 and the timing of light emitting operation of each semiconductor laser.

Although the red light beam R and the green light beam G travel the same optical path to the polygonal rotating mirror 2 as shown in FIGS. 1 and 3, the red light beam R and the green light beam G fall at different positions, respectively, on the document 6 because the red light beam R and the green light beam G fall on the polygonal rotating mirror 2 at different times, respectively, are deflected by the polygonal rotating mirror 2, and fall on the document 6 at different times, respectively.

As shown in FIG. 5, crosstalk (interference) between the light beams R and G can be prevented when the duration of the on state of each of the lasers 1R and 1G is less than half the dot clock T (T/2). The image on the document 6 can be scanned without missing scanning any dots by forming spots of the light beams R and G in a diameter substantially equal to the dot width.

Time elapsed from the signal provided once in each scanning cycle by the BD sensor 8 is used as absolute reference time for timing light emission. Thus, the clock timing of the semiconductor lasers 1R and 1G can be matched.

Figure 6A:
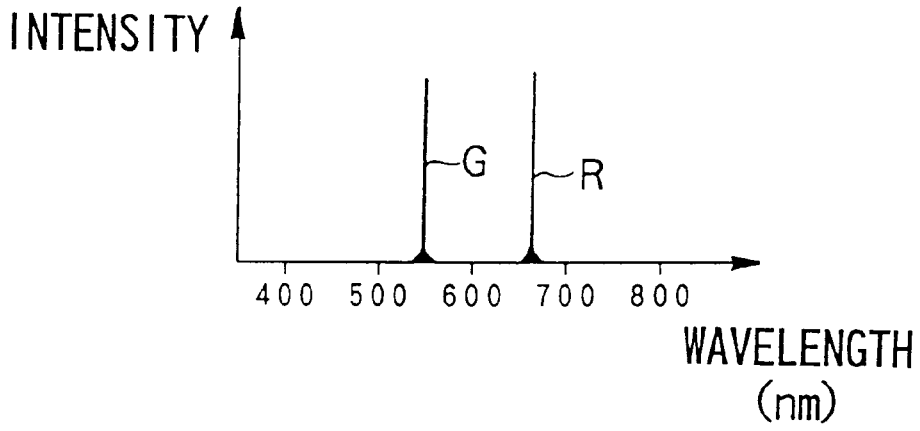
FIGS. 6A, 6B, and 6C are graphs showing the spectral characteristics of a red semiconductor laser and a green semiconductor laser, those of the red semiconductor laser, and those of the green semiconductor laser included in the optical scanning apparatus in the first embodiment, respectively.
Figure 6B:
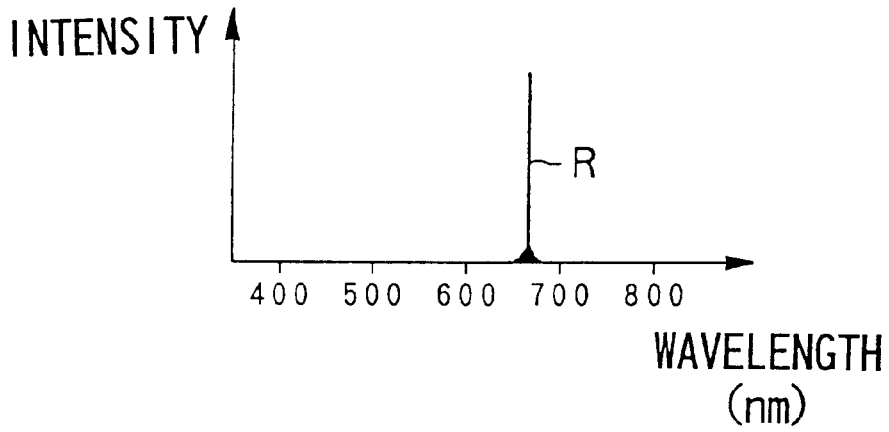
Figure 6C:
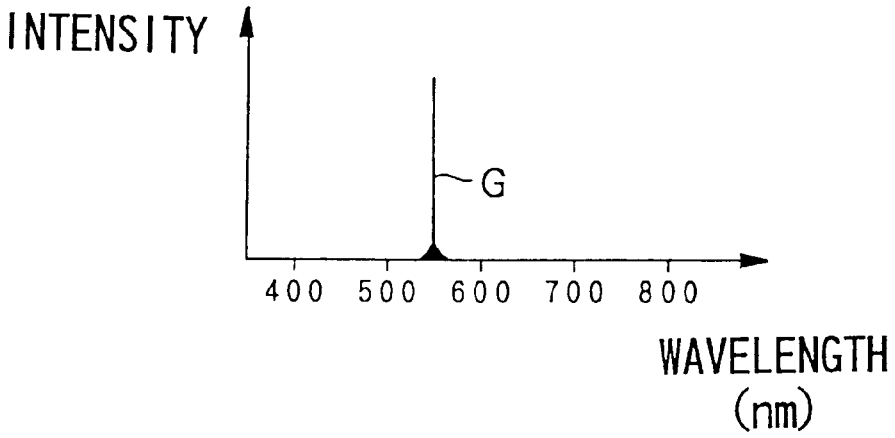

As shown in FIG. 6A, the respective oscillation wavelengths of the red light beam R and the green light beam G are about 670 nm and about 550 nm.

If only the red light beam R (FIG. 6B) or the green light beam G (FIG. 6C) is used for reading a multicolor image on the document 6, some portions of the image cannot be read. For instance, portions of the image printed in magenta (red) ink having a high reflectivity for radiations of wavelengths in the range of about 600 nm to about 700 nm cannot be read when only the red light beam R is used, and portions of the image printed in cyan (blue) ink having a high reflectivity for radiations of wavelengths in the range of about 400 nm to about 600 nm cannot be read when only the green light beam G is used.

Referring again to the flow chart shown in FIGS. 4A and 4B, when the image on the document 6 is a multicolor image, i.e., when the response in step S106 is affirmative, the red semiconductor laser 1R and the green semiconductor laser 1G are driven for light emission at different times, respectively, in step S122. When the red light beam R and the green light beam G are thus emitted with a time difference, a signal given by operating the keyboard, not shown, is examined in step S124 to see whether or not color density detection is necessary.

Color density detection signifies a process using only the light beam of a color corresponding to a dominant color (color of the highest chroma) in a portion of the image on the document 6, i.e., a light beam that is attenuated by the largest attenuation from its white level when reflected from a portion of the dominant color, and forming image information about the image of the document 6 using the difference in color density of the used light beam. The sharpness of image information obtained by using color density detection is higher than that of image information obtained without using color density detection.

When it is decided that a signal not requesting color density detection is given, i.e., when the response in step S124 is negative, the mean attenuation, i.e., the mean of the attenuation of the reflected red light beam R relative to the white level and that of the reflected green light beam G relative to the white level, is calculated in step S126 on the basis of a synthesized signal obtained by synthesizing image signals provided by the photodiodes 7*a,* 7*b* and 7*c*. The mean attenuation for each dot corresponding to one dot on a recorded image is converted into density difference of a portion of a color corresponding to the color of the light image fallen on the same portion in step S128. The image information represented by the density difference is stored in the read buffer 34A of the RAM 34 in step S130. The output of the BD sensor 8 is examined in step S132 to see whether or not one scanning cycle for scanning one scanning line has been completed. When the scanning cycle has not been completed, i.e., when the response in step S132 is negative, the program returns to step S126 to obtain image information about the next dot.

After the scanning line has entirely been scanned, i.e., when the response in step S132 is affirmative, the image information for one scanning line stored in the read buffer 34A is transferred to the image memory 34B of the RAM 34 in step S134. Subsequently, a query is made in step S136 to see whether or not all the scanning lines on one page have been scanned. When the response in step S136 is negative, the program returns to step S126 to continue the scanning operation. When the response in step S136 is affirmative, the image reading program is ended.

When a signal requesting color density detection is given, i.e., when the response in step S124 is affirmative, the greater one of the attenuation relative to the white level of the reflected red light beam R and the attenuation relative to the white level of the reflected green light beam G is detected for the dot width (the width A shown in the bottom diagram in FIG. 5) on the document 6 in step S138.

Color density detection will more concretely be described with reference to FIGS. 7A, 7B, 7C and 7D showing the spectral characteristics of magenta, cyan, black and yellow, i.e., fundamental colors for printing ink, respectively, in combination with the spectral characteristics of the red light beam R and the green light beam G, in which continuous lines are for the colors of high chroma, and broken lines are for those of low chroma.

Figure 7A:
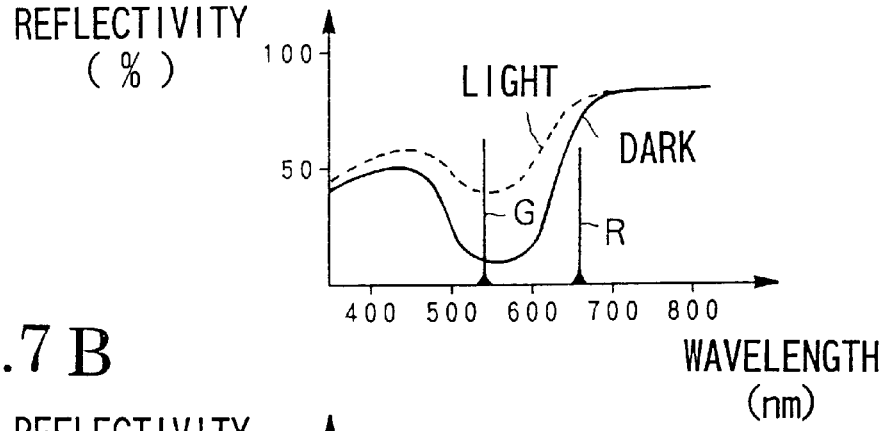
FIGS. 7A, 7B, 7C and 7D are graphs showing the relations between the spectral characteristics of the semiconductor lasers, and those of magenta ink, those of cyan ink, those of black ink and those of yellow ink, respectively.
Figure 7B:
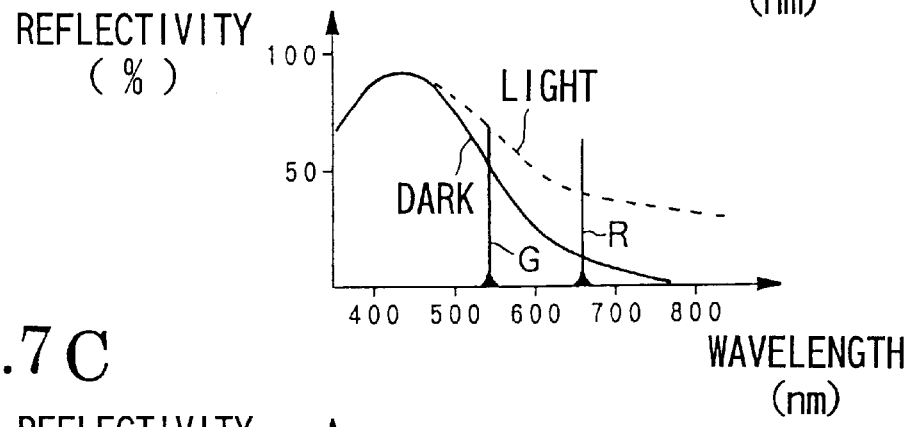
Figure 7C:
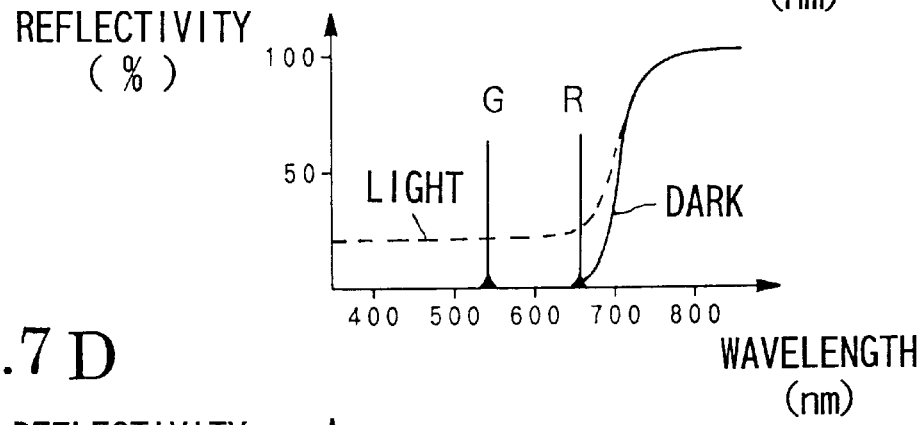

As is obvious from FIGS. 7A to 7D showing attenuation for magenta, cyan, black and yellow colors, respectively, the attenuation relative to the white level of the green light beam G is large when reading portions of the image in which magenta ink is dominant, i.e., in FIG. 7A, the reflectivity of portions in which magenta ink is dominant for the green light beam G is low, and hence image information representing a sharp image can be obtained when the green light beam G is used for reading portions of the image in which magenta is dominant. The attenuation relative to the white level of the red light beam R is large when reading portions of the image in which cyan ink is dominant, i.e., in FIG. 7B, the reflectivity of portions in which cyan ink is dominant for the red light beam R is low, and hence image information representing a sharp image can be obtained when the red light beam R is used for reading portions of the image in which cyan is dominant. Although either light beam may be used for reading portions of the image in which black ink is dominant, as shown in FIG. 7C, generally, the green light beam G which is attenuated by the largest attenuation relative to the white level by black portions is used.

Figure 7D:
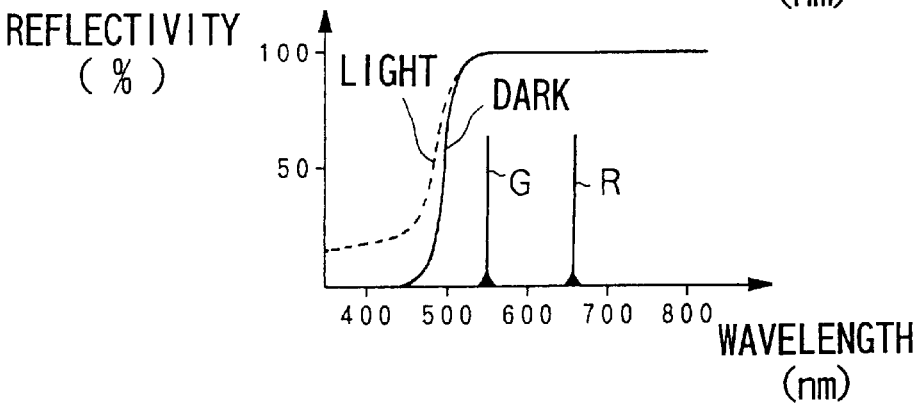

As is obvious from FIG. 7D, portions of the image in which yellow ink is dominant reflect the green light beam G and the red light beam R substantially totally. Therefore, portions in which yellow ink is dominant are recognized as white portions, i.e., the same color as that of the ground of the document 6, when any of the red light beam R and the green light beam G is used and hence yellow portions, such as yellow characters, cannot be read. However, characters and the like are rarely printed in yellow ink and no significant problem arises even if portions printed in yellow ink are regarded as white portions. Therefore, practically, image information exactly representing the image on the document 6 in a satisfactory resolution can be generated when the red light beam R and the green light beam G are used.

When pin (p-insulator-n) photodiodes capable of quick detection are employed as the photodiodes 7*a,* 7*b* and 7*c,* the reflected light beam for each dot can be changed in the detection in step S138 of the flow chart shown in FIG. 4B.

The attenuation of the light beam suitable for detecting a color dominant in a dot, i.e., the light beam which is attenuated by the largest attenuation by the color dominant in a dot, is converted into a density relative to the white level of the dot for each dot in step S140. Image information expressed by the density is stored in the read buffer 34A of the RAM 34 in step S142. The output of the BD sensor 8 is examined in step S144 to see whether or not one scanning cycle for scanning one scanning line has been completed. When the scanning cycle has not been completed, i.e., when the response in step S144 is negative, the program returns to step S138 to obtain image information about the next dot.

After the scanning line has entirely been scanned, i.e., when the response in step S144 is affirmative, the image information for one scanning line stored in the read buffer 34A is transferred to the image memory 34B of the RAM 34 in step S146. Subsequently, a query is made in step S148 to see whether or not all the scanning lines on one page have been scanned. When the response in step S148 is negative, the program returns to step S138 to continue the scanning operation. When the response in step S148 is affirmative, the image reading program is ended.

Thus, the image information about the image on the document 6 is generated and stored in the RAM 34 by the foregoing operation according to instructions given by the operator.

Although the foregoing image reading procedure decides the color type of the image on the document, i.e., a multicolor type or a non-multicolor type, on the basis of the color type signal given by the operator, the color density detection may be executed after the white level has been set in step S102 and the document 6 has been placed on the document table 9 in step S104 to determine the color densities and to determine the color type of the image on the document 6; it may be decided that the image on the document 6 is of a monochromatic type when the density difference between the two light beams is less than a predetermined value, or that the image on the document 6 is of a multicolor type when the density difference is not smaller than the predetermined value.

(C) Operation of Image Recording System

Image recording operation for recording an image represented by the image information stored in the RAM 34 by the foregoing image reading operation will be described hereinafter.

When recording an image, the reflecting mirror 4 is turned to a position indicated by continuous lines in FIG. 2 by the motor, not shown, to deflect the light beams R and G toward the photoconductive body 20. Then, either the red semiconductor laser 1R or the green semiconductor laser 1G is actuated to project the red light beam R or the green light beam G in intensities corresponding to the image information recorded in the image memory 34B of the RAM 34. Any one of the red light beam R and the green light beam G to which the photoconductive body 20 is more sensitive may be used. In this embodiment, the green light beam G emitted by the green semiconductor laser 1G is used for convenience' sake.

The image information used herein may be information about the image on the document 6 obtained by the image reading operation, information provided by a computer or the like or information received through a telephone line by facsimile equipment.

The green light beam G emitted by the green semiconductor laser 1G falls on the polygonal rotating mirror 2 and is deflected for scanning by the rotation of the polygonal rotating mirror 2. The deflected green light beam G is focused by the focusing lens 3 and the focused green light beam G falls on the reflecting mirror 4. Then, the reflecting mirror 4 reflects the green light beam G onto the photoconductive body 20 to form an electrostatic latent image represented by the image information on the photoconductive body 20.

As shown in FIG. 1, the reflecting mirror 4 is disposed so that the distance A1 between the reflecting mirror 4 and the surface of the document 6 is equal to the distance A2 between the reflecting mirror 4 and the surface of the photoconductive body 20. Therefore, the scanning range on the surface of the document 6 and that on the surface of the photoconductive body 20 are substantially equal to each other, and hence an image of the same size as that of the image read by the image reading operation can be recorded on the photoconductive body 20. The electrostatic latent image formed on the photoconductive body 20 is developed in a toner image by using a known monochromatic toner or the like, and the toner image is transferred to a recording sheet, not shown, to print a monochromatic image on the recording sheet.

Although the red semiconductor laser 1R or the green semiconductor laser 1G is used in this embodiment, the present invention may employ a light source comprising, in combination, a solid state laser that emits light of a fixed wavelength, such as a YAG laser, and a nonlinear optical harmonic generating element capable of generating a light beam having a frequency which is an integral multiple of the incident laser beam emitted by the solid state laser, such as an SHG element.

As is apparent from the foregoing description, since the image reading operation and the image recording operation of the optical scanning system S in the first embodiment use both the red light beam R and the green light beam G for reading a multicolor image on the document, all the portions having different colors of the image excluding yellow portions can be read and hence image information substantially exactly and sharply representing the image on the document 6 can be obtained without entailing any practical problems, so that the image on the document 6 can be reproduced with fidelity and a sharp copy of the image can be produced.

Since the red light beam R and the green light beam G are projected at the same position on the document 6 at different moments, respectively, the red light beam R and the green light beam G are reflected individually, the color separating ability of the image information based on the reflected light beams is improved, the resolution of the image information is improved, and the optical scanning apparatus is able to read the image on the document 6 more rapidly than an optical scanning apparatus that repeats a scanning cycle for a plurality of light beams.

The color density detection is executed when necessary, the image information represents the image on the document 6 more sharply.

Since the semiconductor lasers are used for both the image reading operation and the image recording operation, the structure of the optical scanning apparatus S can be simplified.

(II) Second Embodiment

An optical scanning apparatus S' in a second embodiment according to the present invention will be described hereinafter with reference to FIGS. 8 to 11.

The optical scanning apparatus S' in the second embodiment is provided with, in addition to a red semiconductor laser 1R and a green semiconductor laser 1G, a blue semiconductor laser unit 13 including a blue semiconductor laser 1B that emits a blue light beam B. In the following description, parts and steps of operations similar to those of the first embodiment are designated by the same reference characters and the same step numbers and the detailed description thereof will be omitted.

(A) Structure of Optical Scanning Apparatus

The structure of the optical scanning apparatus S' in the second embodiment as applied to a copying machine having an optical system serving as both an image reading system and an image recording system will be described with reference to FIG. 8.

Figure 8:
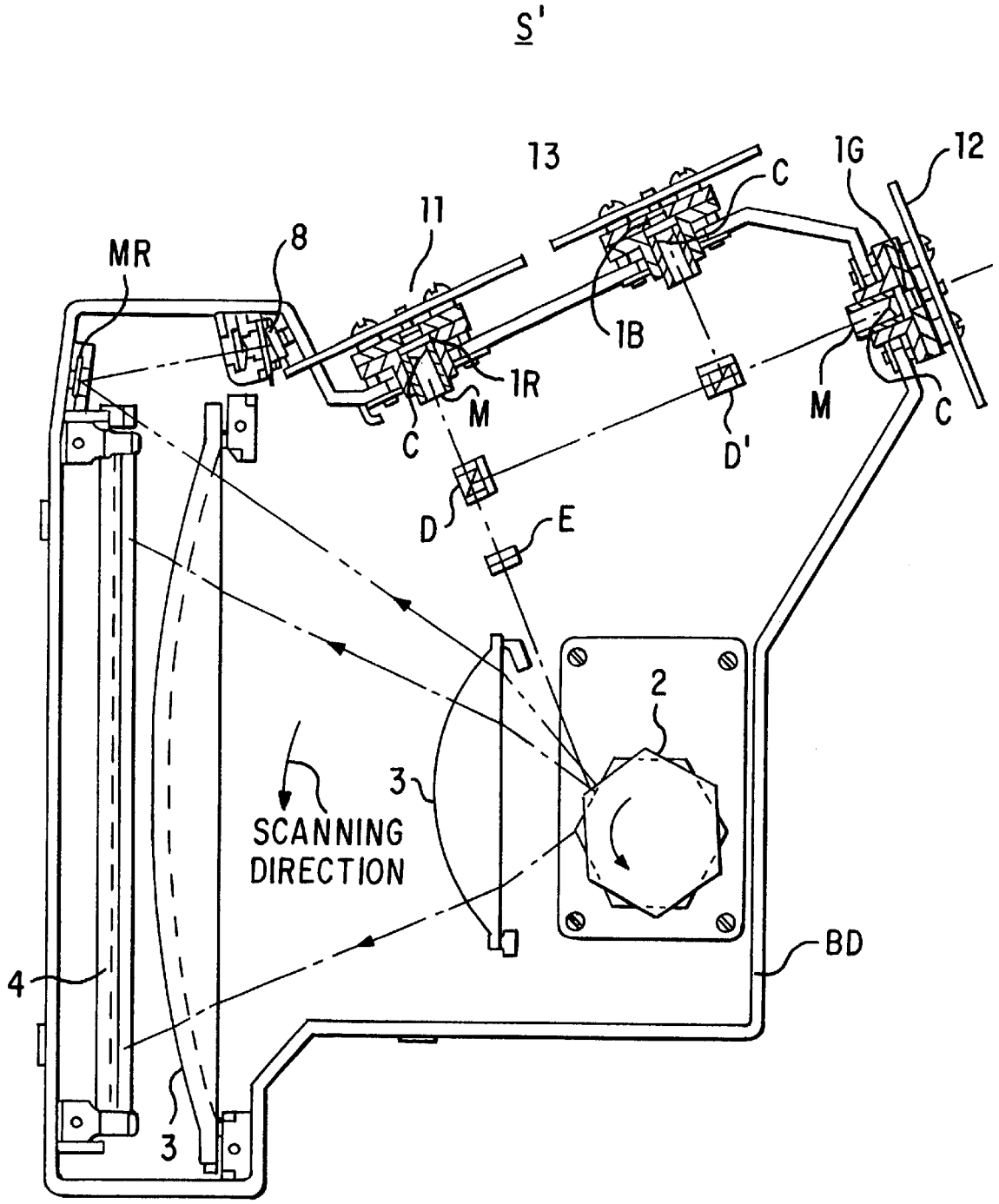
FIG. 8 is a schematic sectional view of an optical scanning apparatus in a second embodiment according to the present invention.

Referring to FIG. 8, the optical scanning apparatus S' has an image reading system that includes a red semiconductor laser 1R, a green semiconductor laser 1G and a blue semiconductor laser 1B, which serve as light sources and recording light beam emitting means, two dichroic mirrors D and D' to guide the light beams R, G and B onto the same optical path, a polygonal rotating mirror 2, a focusing lens 3 and a reflecting mirror 4. The dichroic mirrors D and D', the polygonal rotating mirror 2, the focusing lens 3 and the reflecting mirror 4 guide the red light beam R, the green light beam G and the blue light beam B to the same position on a document 6. The rest of the components and their arrangement and functions in the second embodiment are the same as those in the first embodiment and hence the description thereof will be omitted.

(B) Operation of Image Reading System

The operation of the image reading system of the optical scanning apparatus S' will be described with reference to FIGS. 9A to 11.

Figure 9A:
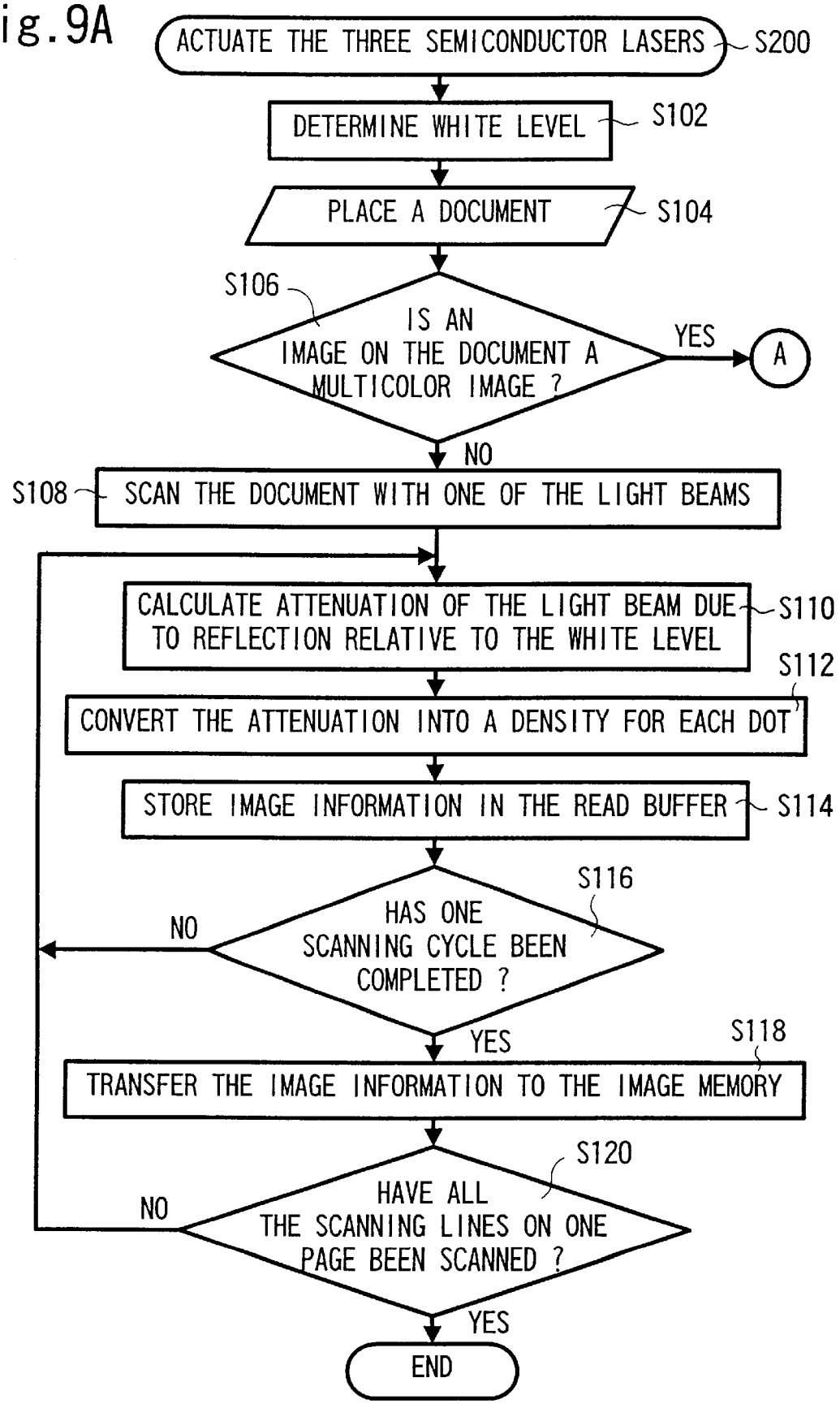
FIGS. 9A and 9B show a flow chart of an image reading procedure to be carried out by the optical scanning apparatus in the second embodiment.
Figure 9B:
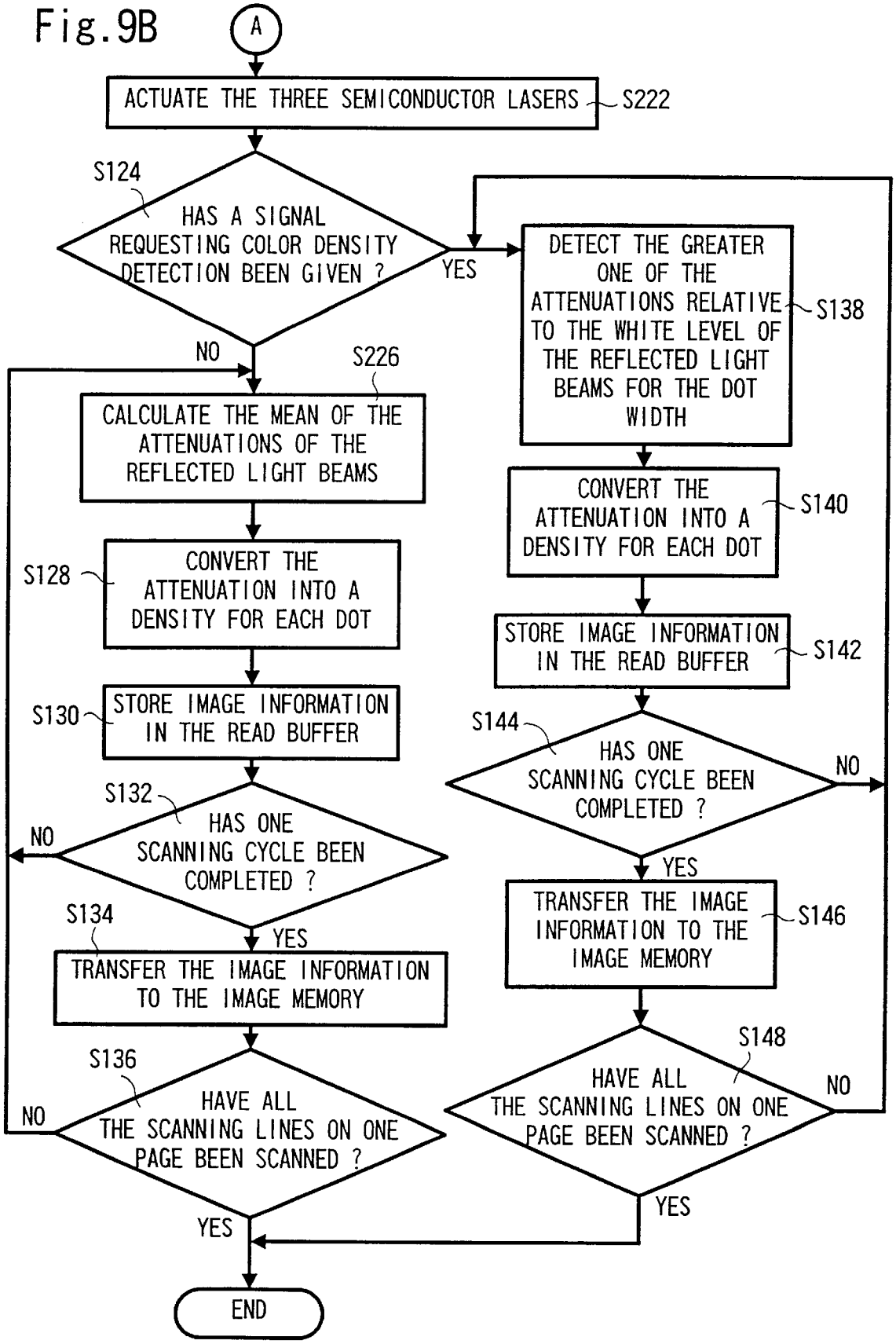

As shown in FIG. 9A, the operation of the image reading system in the second embodiment differs from that of the image reading system in the first embodiment in that the red semiconductor laser 1R, the green semiconductor laser 1G and the blue semiconductor laser 1B are actuated sequentially when setting white level in step S200, the red semiconductor laser 1R, the green semiconductor laser 1G and the blue semiconductor laser 1B are actuated at different moments, respectively, in step S222, as shown in FIG. 9B, and the mean attenuation of the attenuation of the red light beam R relative to the white level, the attenuation of the green light beam G relative to the white level and the attenuation of the blue light beam B relative to the white level is calculated in step S226.

That is, in the image reading system of the second embodiment, the red semiconductor laser 1R, the green semiconductor laser 1G and the blue semiconductor laser 1B are successively actuated, and thereafter steps S102 though S106 similar to those of the first embodiment are performed.

When a color type signal does not indicate a multicolor document, i.e., when the response in step S106 is negative, the red semiconductor laser 1R, the green semiconductor laser 1G or the blue semiconductor laser 1B is actuated in step S108. For instance, the green semiconductor laser 1G is actuated in step S108 to emit the green light beam G. The red light beam R, the green light beam G or the blue light beam B is selected by the operator with reference to colors of an image on the document 6 placed on the document table 9 in step S104, and the light beam that is attenuated most greatly when reflected from the image than the others is selected.

Subsequently, steps S110 to S120, which are similar to those in the first embodiment, are executed to store image information representing the image on the document 6 in the image memory 34B of the RAM 34.

When a color type signal indicating a multicolor image is given, i.e., the response to a query in step S106 is affirmative, the red semiconductor laser 1R, the green semiconductor laser 1G and the blue semiconductor laser 1B are actuated sequentially in step S222 so that the red light beam R, the green light beam G and the blue light beam B are emitted at different moments, respectively. The red light beam R, the green light beam G and the blue light beam B travel through the dichroic mirrors D and D', the polygonal rotating mirror 2, the focusing lens 3 and the reflecting mirror 4 and fall on the surface of the document 6. The timing of the light emitting operations of the red semiconductor laser 1R, the green semiconductor laser 1G and the blue semiconductor laser 1B is controlled by the CPU 31. A mode of light emission timing operation will be described with reference to FIG. 10.

Figure 10:
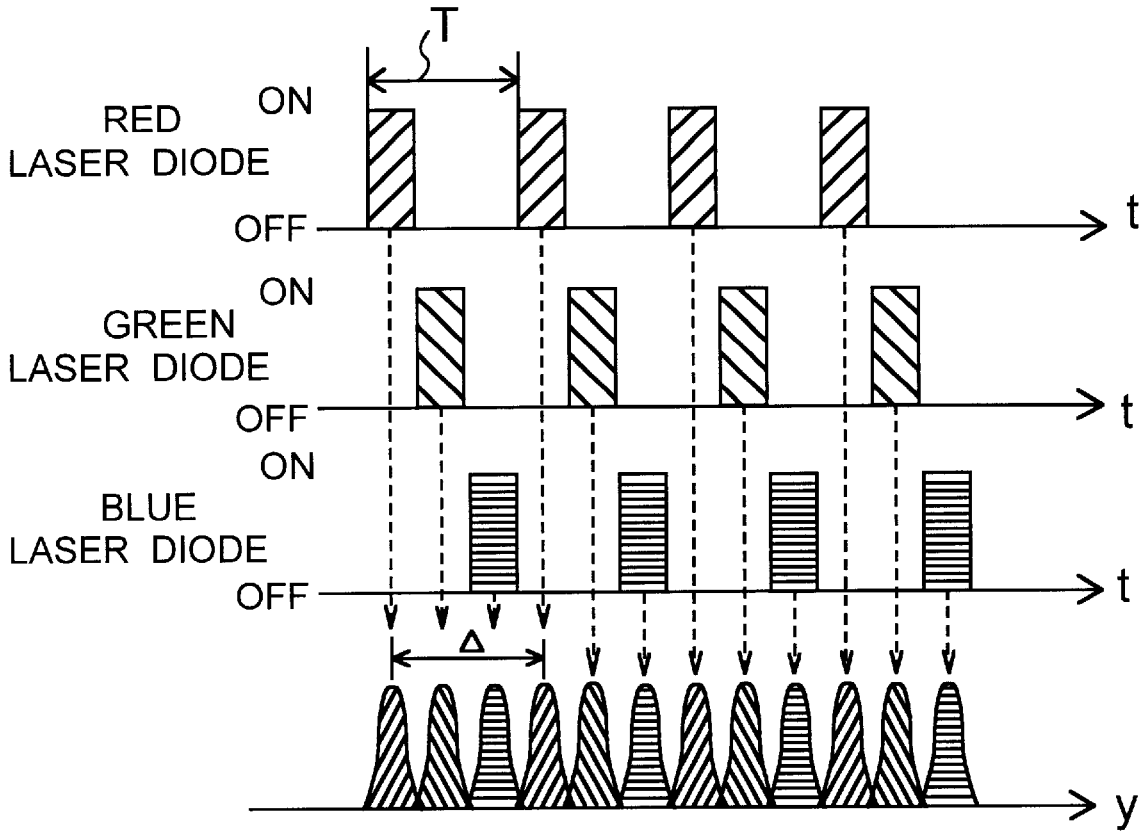
FIG. 10 is a timing chart of assistance in explaining the timing of light emitting operations of semiconductor lasers included in the optical scanning apparatus in the second embodiment.
Figure 11A:
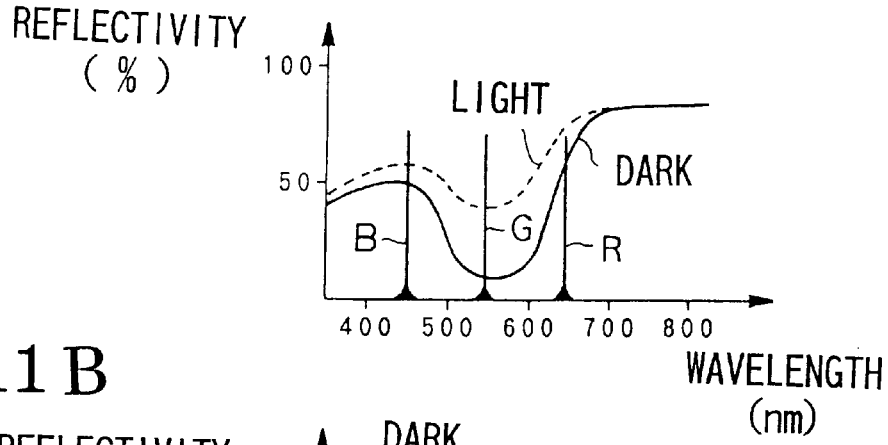
FIGS. 11A, 11B, 11C and 11D are graphs showing the relations between the spectral characteristics of the semiconductor lasers, and those of magenta ink, those of cyan ink, those of black ink and those of yellow ink, respectively.
Figure 11B:
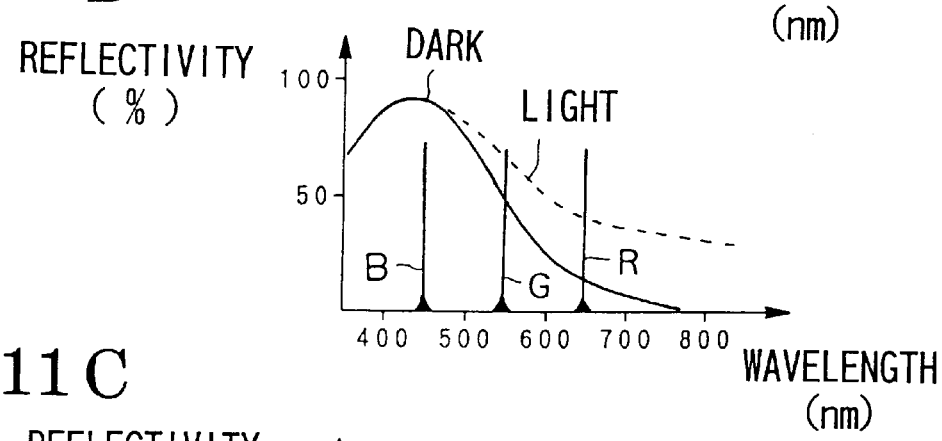
Figure 11C:
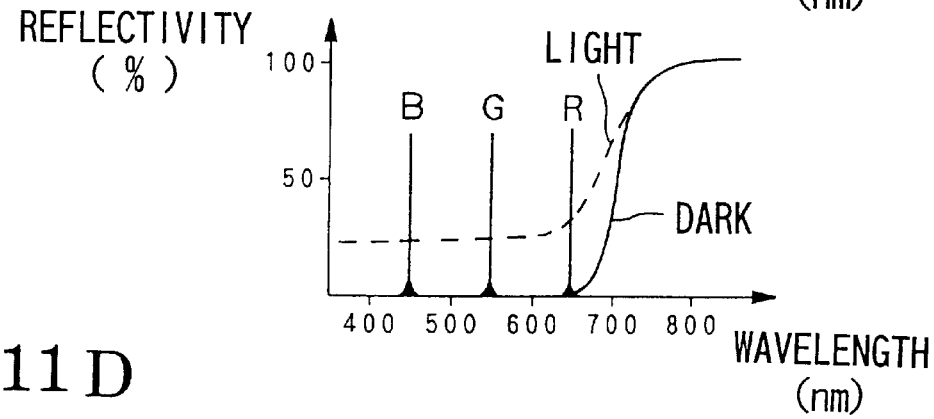
Figure 11D:
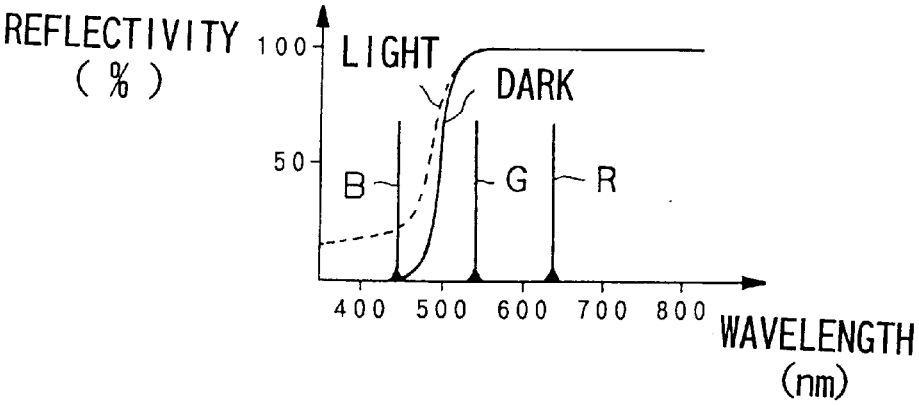

In FIG. 10, the top diagram shows the light emitting operation of the red semiconductor laser 1R, the second top diagram shows the light emitting operation of the green semiconductor laser 1G, the third top diagram shows the light emitting operation of the blue semiconductor laser 1B, and the bottom diagram shows the intensity distribution of spots of the red light beam R, the green light beam G and the blue light beam B on the document 6.

As shown in FIG. 10, the red semiconductor laser 1R, the green semiconductor laser 1G and the blue semiconductor laser 1B emit the red light beam R, the green light beam G and the blue light beam B, respectively, once in each dot clock T and the duration of each of the red light beam R, the green light beam G and the light beam B is shorter than T/3.

In the bottom diagram in FIG. 10, one dot width on the document 6 is indicated by a mark Δ. The red light beam R, the green light beam G or the blue light beam B is projected at a position in one dot width on the document 6. The position of incidence is determined by controlling the rotating speed of the polygonal rotating mirror 2 and the timing of the light emitting operation of each semiconductor laser. Although the red light beam R, the green light beam G and the blue light beam B travel the same optical path to the polygonal rotating mirror 2 as shown in FIG. 8, the red light beam R, the green light beam G and the blue light beam B fall at different positions, respectively, on the document 6 because the red light beam R, the green light beam G and the blue light beam B fall on the polygonal rotating mirror 2 at different times, respectively, are deflected by the polygonal rotating mirror 2, and fall on the document 6 at different times, respectively.

As shown in FIG. 10, crosstalk (interference) between the light beams R, G and B can be prevented when the duration of the on state of each of the lasers 1R, 1G and 1B is less than one-third the dot clock T (T/3). The image on the document 6 can be scanned without missing scanning any dots by forming spots of the light beams R, G and B in a diameter substantially equal to the dot width.

The oscillation wavelength of the blue light beam B is about 450 nm.

The red semiconductor laser 1R, the green semiconductor laser 1G and the blue semiconductor laser 1B are driven for light emission at different times, respectively, in step S222 of the procedure shown in FIG. 9. When the red light beam R, the green light beam G and the blue light beam B are thus emitted with a time difference, a signal given by operating a keyboard, not shown, is examined in step S124 to see whether or not color density detection is necessary.

When it is decided that a signal not requesting color density detection is given, i.e., when the response in step S124 is negative, the mean attenuation, i.e., the mean of the attenuation of the reflected red light beam R relative to the white level and that of the reflected green light beam G relative to the white level and that of the reflected blue light beam B relative to the white level, is calculated in step S226 on the basis of a synthesized signal obtained by synthesizing image signals provided by the photodiodes 7*a,* 7*b* and 7*c*. Then, similarly to the procedure in the first embodiment, steps S226 to S136 are executed and image information representing the image on the document 6 is stored in the image memory 34B of the RAM 34.

When a signal requesting color density detection is given, i.e., when the response in step S124 is affirmative, the greatest one of the attenuation relative to the white level of the reflected red light beam R, the attenuation relative to the white level of the reflected green light beam G and the attenuation relative to the white level of the reflected blue light beam B is detected for the dot width (the width A shown in FIG. 10) on the document 6 in step S138.

Color density detection using the three light beams will be described with reference to FIGS. 11A, 11B, 11C and 11D showing the spectral characteristics of magenta, cyan, black and yellow, i.e., fundamental colors for printing ink, respectively, in combination with the spectral characteristics of the red light beam R, the green light beam G and the blue light beam B.

As is obvious from FIGS. 11A to 11D, the green light beam G is used for reading portions of the image in which magenta ink is dominant, and the red light beam R is used for reading portions of the image in which cyan ink is dominant. Although any one of the light beams R, G and B may be used for reading portions of the image in which black ink is dominant, generally, the blue light beam B which is attenuated by the largest attenuation relative to the white level by black portions having low reflectivity for the blue light beam B is used.

In the first embodiment, portions of the image in which yellow ink is dominant cannot be read due to the relation in spectral characteristic between the green light beam G and the red light beam R, and yellow ink. In the second embodiment, the blue light beam B which is attenuated by a large attenuation by portions in which yellow ink is dominant is used for reading portions of the image in which yellow ink is dominant, so that image information representing a sharp image can be obtained.

The respective attenuations of the light beams R, G and B are determined in step S138, steps S138 through S148 are executed, and the image information representing the image on the document 6 is stored in the image memory 34B of the RAM 34.

(C) Operation of Image Recording System

Image recording operation of the second embodiment will be described hereinafter.

Basically, the image recording operation of the second embodiment is the same as that of the first embodiment, except that, in the second embodiment, one of the red light beam R, the green light beam G and the blue light beam B is used for image recording. Any one of the red light beam R, the green light beam G and the blue light beam B to which the photoconductive body 20 is most sensitive may be used.

The image recording operation of the second embodiment is the same in other respects as that of the first embodiment and hence further description of the image recording operation will be omitted.

As is apparent from the foregoing description, the image reading operation and the image recording operation of the optical scanning apparatus S' in the second embodiment have an effect, in addition to those of the first embodiment, that all the portions having different colors of a multicolor image can be read and hence image information exactly and sharply representing the image on the document 6 can be obtained, so that the image on the document 6 can be reproduced with fidelity and a sharp copy of the image can be produced.

Since blue semiconductor lasers, i.e., semiconductor lasers having oscillation wavelengths not greater than 600 nm, are not yet used widely for practical purposes, a solid state laser which emits a laser beam of a fixed wavelength, and an element capable of generating a light beam of a frequency which is an integral multiple of that of the incident laser beam, such as an SHG, are used in combination to use the blue light beam B.

Since the red light beam R, the green light beam G and the blue light beam B are projected at the same position on the document 6 at different moments, respectively, the red light beam R, the green light beam G and the blue light beam B are reflected individually, the light receiving unit 7 that receives the reflected light beams need not be provided with any filters for separating the reflected light beams of different colors and the structure of the optical scanning apparatus S' can be simplified.

(III) Modifications

Although the first and the second embodiments have been described as applied to copying machines capable of reading a multicolor image on a document and of producing a monochromatic copy of the multicolor image, the present invention is not limited thereto in its application and is applicable to copying machines capable of reading a multicolor image and producing a multicolor copy of the multicolor image.

When the present invention is applied to a copying machine capable of multicolor reading-recording operation, the red light beam R, the green light beam G and the blue light beam B are projected at different moments on a document carrying an image, the respective color densities of the light beams R, G and B are determined individually, and those color densities are combined to produce a multicolor copy of the image.

Although the image recording system of the first embodiment employs the red light beam R or the green light beam G and the image recording system of the second embodiment employs the red light beam R, the green light beam G or the blue light beam B for scanning the surface of the photoconductive body 20, the image recording systems may be provided specially for image recording with an infrared semiconductor laser and an infrared beam emitted by the infrared semiconductor laser may be used for the image recording operation.

Figure 12:
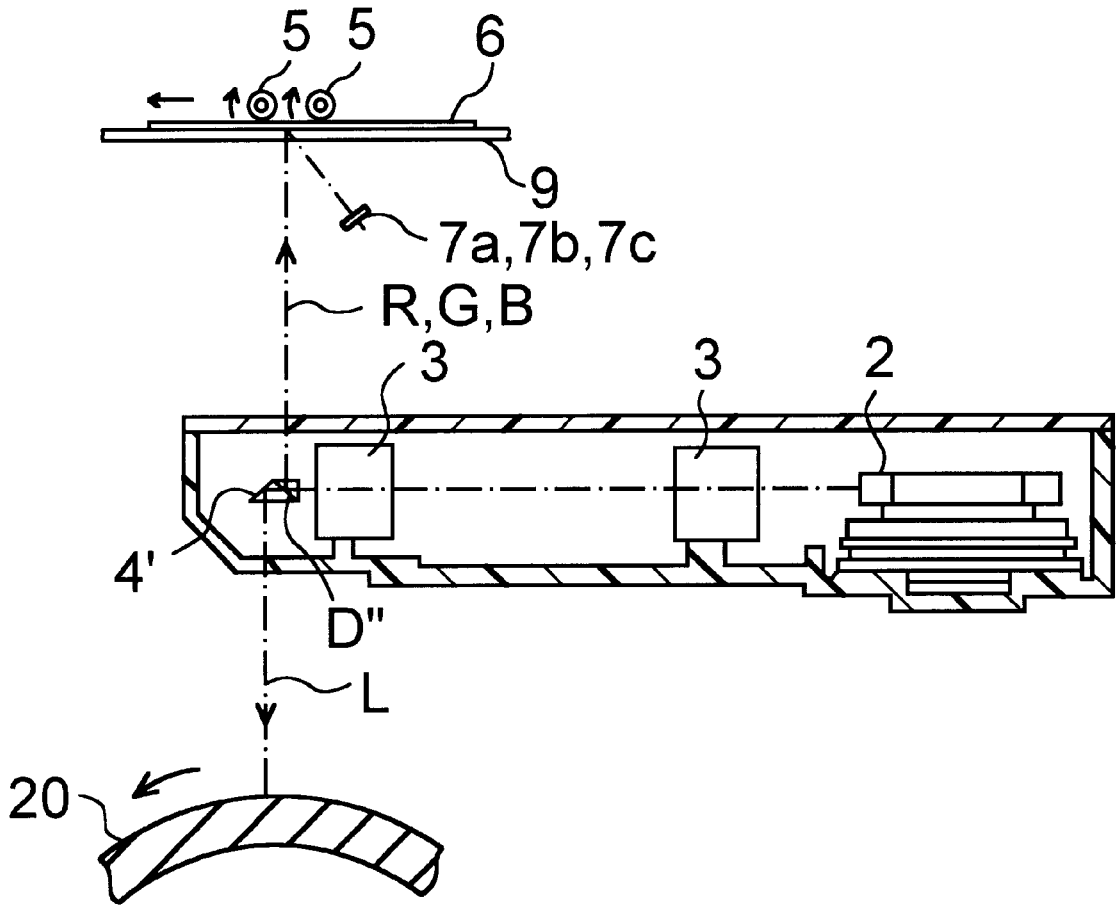
FIG. 12 is a partly sectional side view of a modification of the optical scanning apparatuses.

An arrangement shown in FIG. 12 is used when an infrared semiconductor laser is used specially for the image recording operation. Referring to FIG. 12, an infrared beam L emitted by the infrared semiconductor laser is deflected for scanning by a polygonal rotating mirror 2, travels through a focusing lens 3, penetrates into a dichroic mirror D", and is reflected by a reflecting mirror 4' of the dichroic mirror D" onto the surface of a photoconductive body 20 to record an image on the photoconductive body 20. The surface of the photoconductive body 20 is formed of a material sensitive to the infrared beam L.

The dichroic mirror D" transmits the infrared beam L, and reflects the red light beam R, the green light beam G and the blue light beam B, which are employed in the image reading operation, toward the document 6.

When the infrared beam L and the dichroic mirror D" are employed, the reflecting mirror 4 and the motor for moving the reflecting mirror 4 are unnecessary, so that the structure of the copying machine can be simplified.

While this invention has been described in conjunction with specific embodiments thereof, it is evident that many alternatives, modifications and variations will be apparent to those skilled in the art. Accordingly, preferred embodiments of the invention as set forth herein are intended to be illustrative, not limiting. Various changes may be made without departing from the spirit and scope of the invention as defined in the following claims.

What is claimed is:

1. An optical scanning method, comprising the steps of:

emitting a plurality of light beams having different wavelengths, respectively;

deflecting the plurality of light beams to scan a white plate;

detecting a plurality of reflected light beams reflected from the white plate;

deflecting the plurality of light beams to scan an object;

controlling luminous intensities of the plurality of light beams that scan the object based on intensities of the plurality of light beams previously reflected from the white plate;

detecting a plurality of reflected light beams reflected from the object; and generating image information, the image information representing the object based on the plurality of reflected light beams reflected from the object.

2. An optical scanning method according to claim 1, wherein the plurality of light beams are emitted at different moments, respectively.

3. An optical scanning method according to claim 1, wherein one of the plurality of reflected light beams reflected from the object is selected, the selected one of the plurality of reflected light beams corresponding to a color of a portion of the object, the image information being generated based on the selected one of the plurality of reflected light beams.

4. An optical scanning apparatus, comprising:

a light emitter that emits a plurality of light beams having different wavelengths, respectively;

a light deflector that deflects the plurality of light beams emitted by the light emitter to scan a white plate or an object, the deflected plurality of light beams becoming a plurality of deflected light beams;

a light receiving device that receives a plurality of reflected light beams reflected from the white plate or a plurality of reflected light beams reflected from the object;

a controller that controls luminous intensities of the plurality of light beams that scan the object based on intensities of the plurality of light beams previously reflected from the white plate, and an image generator that generates image information representing the object based on the plurality of reflected light beams reflected from the object.

5. An optical scanning apparatus according to claim 4, wherein the light emitter includes a light emission timing controller that controls a timing of emission of the plurality of light beams so that the plurality of light beams are emitted at different moments, respectively.

6. An optical scanning apparatus according to claim 4, wherein the image generator includes a selector that selects one of the plurality of reflected light beams reflected from the object the selected one of the plurality of light beams corresponding to a color of a portion of the object, the image information being generated based on the selected one of the plurality of reflected light beams.

7. An optical scanning apparatus according to claim 6, wherein the light receiving device comprises a plurality of light receiving elements.

8. An optical scanning apparatus according to claim 4, wherein the light emitter comprises a plurality of light emitting elements.

9. An optical scanning apparatus according to claim 8, wherein a first one of the plurality of light emitting elements is a red light emitting element emitting a wavelength of red light and a second one of the plurality of light emitting elements is a green light emitting element emitting a wavelength of green light.

10. An optical scanning apparatus according to claim 8, wherein a first one of the plurality of light emitting elements is a red light emitting element emitting a wavelength of red light, a second one of the plurality of light emitting elements is a green light emitting element emitting a wavelength of green light, and a third one of the plurality of light emitting elements is a blue light emitting element emitting a wavelength of blue light.

11. An optical scanning apparatus according to claim 8, wherein the plurality of light emitting elements are semiconductor lasers.

12. An optical scanning apparatus according to claim 8, wherein at least one of the plurality of light emitting elements has a solid state laser that emits a light beam of a predetermined wavelength, and a wavelength changing element that generates a light beam having a frequency which is an integral multiple of an incident laser light.

13. An optical scanning apparatus according to claim 8, further comprising:

a recording light emitter that emits a recording light beam based on the generated image information;

a recording light deflector that deflects the recording light beam emitted by the recording light emitter for scanning;

a photoconductive body for recording thereon an image represented by the image information; and a recording light director that directs the deflected recording light beam toward the photoconductive body to record the image represented by the image information on the photoconductive body.

14. An optical scanning apparatus according to claim 13, wherein the recording light emitter is one of the plurality of light emitting elements, and the photoconductive body has a photoconductive surface sensitive to the recording light beam emitted by the one of the plurality of light emitting elements.

15. An optical scanning apparatus, comprising:

light beam emitting means for emitting a plurality of light beams having different wavelengths, respectively;

light beam deflecting means for deflecting the plurality of light beams emitted by the light beam emitting means to scan a white plate or an object, the deflected plurality of light beams becoming a plurality of deflected light beams;

light receiving means for receiving a plurality of reflected light beams reflected from the white plate or a plurality of reflected light beams reflected from the object;

a controlling means for controlling luminous intensities of the plurality of light beams that scan the object based on intensities of a plurality of light beams previously reflected from the white plate; and image information generating means for generating image information representing the object based on the plurality of reflected light beams reflected from the object.

16. An optical scanning apparatus according to claim 15, wherein the light beam emitting means includes light emission timing control means for controlling a timing of emission of the plurality of light beams so that the plurality of light beams are emitted at different moments, respectively.

17. An optical scanning apparatus according to claim 15, wherein the light beam emitting means comprises a plurality of light emitting elements and a first one of the plurality of light emitting elements is a red light emitting element emitting a wavelength of red light and a second one of the plurality of light emitting elements is a green light emitting element emitting a wavelength of green light.

18. An optical scanning apparatus according to claim 17, wherein at least one of the plurality of light emitting elements has a solid state laser that emits a light beam of a predetermined wavelength, and a wavelength changing element that generates a light beam having a frequency which is an integral multiple of an incident laser light.

19. An optical scanning apparatus according to claim 17, further comprising:

recording light beam emitting means for emitting a recording light beam based on the generated image information;

deflecting means for deflecting the recording light beam emitted by the recording light beam emitting means for scanning;

a photoconductive body for recording thereon an image represented by the image information; and recording light beam directing means for directing the deflected recording light beam toward the photoconductive body to record the image represented by the image information on the photoconductive body.

20. An optical scanning apparatus according to claim 19, wherein the recording light beam emitting means is one of the plurality of light emitting elements, and the photoconductive body has a photoconductive surface sensitive to the recording light beam emitted by the one of the plurality of light emitting element.

* * * * *